US012560065B1

(12) United States Patent
Sorensen et al.

(10) Patent No.: US 12,560,065 B1
(45) **Date of Patent: *Feb. 24, 2026**

(54) OFFSHORE FRAC HEAD CLAMP APPARATUS AND METHOD OF USE THEREOF

(71) Applicant: Gulfstream Services, Inc., Houma, LA (US)

(72) Inventors: Justin Sorensen, Houma, LA (US); Joey Naquin, Houma, LA (US); Jeffrey J. Arcement, Houma, LA (US); Brian Bordelon, Ville Platte, LA (US)

(73) Assignee: Gulfstream Services, Inc., Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/901,787

(22) Filed: Sep. 30, 2024

Related U.S. Application Data

(63) Continuation of application No. 18/342,914, filed on Jun. 28, 2023, now Pat. No. 12,134,965, which is a continuation of application No. 17/730,832, filed on Apr. 27, 2022, now Pat. No. 11,732,562.

(60) Provisional application No. 63/299,288, filed on Jan. 13, 2022, provisional application No. 63/180,400, filed on Apr. 27, 2021.

(51) Int. Cl.
*E21B 43/26* (2006.01)

(52) U.S. Cl.
CPC ..... *E21B 43/2607* (2020.05); *E21B 43/26* (2013.01)

(58) Field of Classification Search
CPC ..... E21B 43/26; E21B 43/2607
See application file for complete search history.

(56) References Cited

U.S. PATENT DOCUMENTS

| | | | | |
|---|---|---|---|---|
| 2,664,954 | A | 1/1954 | Johnson | |
| 3,965,982 | A | 6/1976 | Medlin | |
| 4,067,389 | A | 1/1978 | Savins | |
| 4,378,845 | A | 4/1983 | Medlin et al. | |
| 4,515,214 | A | 5/1985 | Fitch et al. | |
| 4,549,608 | A | 10/1985 | Stowe et al. | |
| 4,687,061 | A | 8/1987 | Uhri | |
| 4,714,115 | A | 12/1987 | Uhri | |
| 5,443,117 | A | 8/1995 | Ross | |
| 5,636,691 | A | 6/1997 | Hendrickson et al. | |
| 5,787,985 | A | 8/1998 | Oneal et al. | |
| 6,491,097 | B1 | 12/2002 | Oneal et al. | |
| 7,213,641 | B2 | 5/2007 | McGuire et al. | |
| 7,789,133 | B2 | 9/2010 | McGuire | |
| 8,151,885 | B2 | 4/2012 | Bull et al. | |
| 11,732,562 | B1 * | 8/2023 | Sorensen | E21B 43/26 166/90.1 |

* cited by examiner

*Primary Examiner* — James G Sayre
(74) *Attorney, Agent, or Firm* — Garvey, Smith & Nehrbass, Patent Attorneys, L.L.C.; Charles C. Garvey, Jr.; Julie Rabalais Chauvin

(57) ABSTRACT

The present invention relates to clamping devices that connect to a fracking tool body and associated attached flow lines and the method of use thereof. More particularly, the present invention relates to clamping devices that connect to and stabilize a fracking tool body and associated attached flow lines that aid in locating and supporting the inlet connection allowing it to be closer to the rig floor, and consequently, making it safer to install the rest of the rig flow lines.

21 Claims, 25 Drawing Sheets

OFFSHORE FRAC HEAD CLAMP APPARATUS AND METHOD OF USE THEREOF

CROSS-REFERENCE TO RELATED APPLICATIONS

This is a continuation of U.S. patent application Ser. No. 18/342,914, filed 28 Jun. 2023 (issued as U.S. Pat. No. 12,134,965 on 5 Nov. 2024), which is a continuation of U.S. patent application Ser. No. 17/730,832, filed 27 Apr. 2022 (issued as U.S. Pat. No. 11,732,562 on 22 Aug. 2023), which claims the benefit of U.S. Provisional Patent Application Ser. No. 63/180,400, filed 27 Apr. 2021, and U.S. Provisional Patent Application Ser. No. 63/299,288, filed 13 Jan. 2022, which are hereby incorporated herein by reference, and priority of which is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to hydraulic fracturing or hydrofracturing or fracking. More particularly, the present invention relates to clamping devices that connect to a fracking tool body and associated, attached flow lines and the method of use thereof. More particularly, the present invention relates to clamping devices that connect to and stabilize a fracking tool body and associated attached flow lines that aid in locating and supporting the inlet connection allowing it to be closer to the rig floor, and consequently, making it safer to install the rest of the rig flow lines.

2. General Background of the Invention

Hydraulic fracturing can be conducted in an offshore, marine environment. Typically, offshore hydraulic fracturing or "frac" assemblies include a series of high-pressure valves and a multi-inlet flow manifold in line with these valves. From the flow manifold, a series of flow lines are attached to additional flow lines or pipes on the rig floor that connect to a series of pumps through what is called a hydraulic fracturing or "frac" manifold. Each flow line can be independently energized by a specific pump. It is important to note, however, that an offshore "frac" assembly may have several equipment configuration variations depending on a series of application variables.

In an offshore oil well drilling environment, during a hydraulic fracturing activity, typically, a "frac" head is lifted in line with the wellbore and suspended by the well drilling rig elevators. Such "frac" heads are known and commercially available (e.g., Halliburton). The rig's top drive (example shown in FIG. 26) is generally screwed into the top portion of the Frac Head and Valve 21 (see FIG. 1 for reference) is closed in order to isolate "frac" fluid from that of the rig pumps. These rig pumps are rarely used in these operations but are a secondary means of maintaining wellbore integrity. The "frac" head is made up to the workstring extending downhole. Valve 22 and valve 23 (see FIG. 1) are considered the primary and redundant well control valves during hydraulic fracturing operations. Fracturing fluid is pumped through the inlet at a high pressure once the connection between the "frac" head is fully made up to the rest of the rig flow lines. While the fluid is being pumped, it is passing through the flow line illustrated in FIG. 1, through the flow manifold 25 and then the fluid passes through valve 22 and valve 23, thus proceeding downhole via a workstring.

There are several variables involved in determining the final position of the workstring. Thus, the distance from the flow inlet of the frac head to the rig floor is largely unknown until just prior to the frack operations beginning. The frac head flow manifold inlets are typically no less than 25 feet up from the rig floor. The flow lines that are generally used in an offshore hydraulic fracturing operations range in weight but can be approximately fifty pounds per linear foot. This weight and length of flow line presents numerous challenges to processes focused on making up these lines with high-pressure integrity while balancing safety for all personnel involved in the operation of connecting them. One possible solution to this problem is to bring the connection closer to the rig floor. This solution would minimize the length of the flow line that needs to be supported and handled by rig personnel. The present invention focuses on a solution to this dilemma. The present invention provides an improved method and apparatus to locate and support the inlet connection in such a way that it is closer to the rig floor, making it safer to install the rest of the rig flow lines. The present invention provides an improved clamp apparatus that connects to and stabilizes a fracking tool body and associated attached flow lines that aid in locating and supporting the inlet connection, thereby allowing it to be closer to the rig floor.

Typically, hard pipe and flexible pipe flow lines are rigged up to the "frack" head as part of the rigging operation. When flow lines are installed in this manner, there is no rigid support arm securing the pipe during pumping, only whip-check-type support straps. The present invention allows for the secure installation of these flow lines prior to this rigging operation and offers a rigid support structure. An advantage of doing this ahead of the rigging operation is to bring the "rig connection" closer to the rig floor for ease and safety. Offshore personnel currently have to put on fall protection and "go up into the derrick," off of the derrick floor and manhandle this flow line with only the support of a tugger line or crane line. The clamp and support arm of the present invention allow for hard piping down to the rig floor (installed in a controlled shop environment) instead of flow lines up from the rig floor (at heights on the rig site). The present invention allows for users to make up precarious flow lines on the rig floor, not at heights. The clamp/arm of the present invention takes the structural loads instead of the flow line connections.

The following Table 1 lists patents that relate to hydraulic fracturing; each listed patent of Table 1 is hereby incorporated herein by reference.

TABLE 1

| PATENT NO. | TITLE | ISSUE DATE |
|---|---|---|
| U.S. Pat. No. 2,664,954 | HYDRAULIC FRACTURING TO INCREASE WELL PRODUCTIVITY | Jan. 5, 1954 |
| U.S. Pat. No. 3,965,982 | HYDRAULIC FRACTURING METHOD FOR CREATING HORIZONTAL FRACTURES | Jun. 29, 1976 |
| U.S. Pat. No. 4,067,389 | HYDRAULIC FRACTURING TECHNIQUE | Jan. 10, 1978 |
| U.S. Pat. No. 4,378,845 | SAND CONTROL METHOD EMPLOYING SPECIAL HYDRAULIC FRATURING TECHNIQUE | Apr. 5, 1983 |
| U.S. Pat. No. 4,515,214 | METHOD FOR CONTROLLING THE VERTICAL GROWTH OF HYDRAULIC FRACTURES | May 7, 1985 |
| U.S. Pat. No. 4,549,608 | HYDRAULIC FRACTURING METHOD EMPLOYING SPECIAL SAND CONTROL TECHNIQUE | Oct. 29, 1985 |
| U.S. Pat. No. 4,687,061 | STIMULATION OF EARTH FORMATIONS SURROUNDING A DEVIATED WELLBORE BY SEQUENTIAL HYDRAULIC FRACTURING | Aug. 18, 1987 |
| U.S. Pat. No. 4,714,115 | HYDRAULIC FRACTURING OF A SHALLOW SUBSURFACE FORMATION | Dec. 22, 1987 |
| U.S. Pat. No. 5,443,117 | FRAC PACK FLOW SUB | Aug. 22, 1995 |
| U.S. Pat. No. 5,636,691 | ABRASIVE SLURRY DELIVERY APPARATUS AND METHODS OF USING SAME | Jun. 10, 1997 |
| U.S. Pat. No. 5,787,985 | PROPPANT CONTAINMENT APPARATUS AND METHOS OF USING SAME | Aug. 4, 1998 |
| U.S. Pat. No. 6,491,097 | ABRASIVE SLURRY DELIVERY APPARATUS AND METHODS OF USING SAME | Dec. 10, 2002 |
| U.S. Pat. No. 7,213,641 | FRACTURING HEAD WITH REPLACEABLE INSERTS FOR IMPROVED WEAR RESISTANCE AND METHOD OF REFURBISHING SAME | May 8, 2007 |
| U.S. Pat. No. 7,789,133 | EROSION RESISTANT FRAC HEAD | Sep. 7, 2010 |
| U.S. Pat. No. 8,151,885 | EROSION RESISTANT FLOW CONNECTOR | Apr. 10, 2012 |

BRIEF SUMMARY OF THE INVENTION

The present invention relates to clamping devices that connect to a fracking tool body and associated attached flow lines. More particularly, the present invention relates to clamping devices that connect to and stabilize a fracking tool body and associated attached flow lines (4" Chicksan lines, for example) that aid in locating and supporting the inlet connection allowing it to be closer to the rig floor, and consequently, making it safer to install the rest of the rig flow lines.

The present invention includes a primary clamp apparatus and a secondary clamp apparatus. These clamps support the flow lines and stabilize the equipment in such a manner that associated forces do not compromise the integrity of the various flow line connections. A single clamp or multiple clamps may be used depending on the distance needed to bring the lowest connection within a safe handling distance to the rig floor. A preferred embodiment of the clamp apparatus includes a stabilization arm component. The clamp apparatuses of the present invention can symmetrically support all the flow lines required by application.

In a preferred embodiment, the primary clamp device attaches to the exterior of the tool assembly and to the exterior of the flow line. (As seen in FIG. 1, a configuration of an Offshore Frac Head Assembly can have the tool body and the flow line running generally parallel to each other.) A preferred embodiment of the primary clamp includes lock key pockets that can be used to secure the flow line circumferential forces, as well as a clamp force capable of securing gravitational forces and momentary forces.

A preferred embodiment of the primary clamp device apparatus maintains the appropriate distance between flow line in regards to the frac head tool body, thus securing the seal face of the corresponding inlet on the manifold body.

In a preferred embodiment, the primary clamp apparatus includes an integral mechanism that is preferably segmented in such a manner that wraps around the flow line and can be secured so that the flow line is firmly supported. This mechanism can include a bolt or series of bolts that may be preloaded with the necessary torque to maintain the load of the flow line. The mechanism may include a cam-locking handle or other fastening mechanism that keeps the segments of the clamps secure and can independently support the loading of the flow line during hydraulic fracturing operations.

In a preferred embodiment, the primary clamp apparatus also includes a second attaching mechanism that wraps around the body or housing of the frac head or is otherwise attached firmly in such a manner that both the flow line (located adjacent to the body of the frac head) and the frac head body or assembly component are near rigidly supported.

In a preferred embodiment, the position of the clamp assembly apparatus of the present invention can be placed in a targeted location or along any point of the flow line to aid in the position of the flow line connection's proximity to the rig floor, ultimately for the primary purpose of bringing the connection point as close to the rig floor as possible for the safe installation of rig flow iron. The position of the clamp assembly can be placed in a targeted location, near a high-pressure valve (valve 23 in FIG. 1, for example), or along any point or series of points to aid in the position of the flow line to the Frac Head that can aid in the proximity to the rig floor.

In addition to securing radial distance, the primary clamp device apparatus of the present invention may also secure torsional forces and angular position of the flow line in regards to the specific orientation to the frac head assembly as may be required. With both the radial distance and angular position located and firmly set, flow line components can be placed in such a manner that the rig connection can be in a very specific location. The primary clamp device apparatus of the present invention allows for the preplanning of the location of the rig flow line connection and allows for the rig flow line connection to be as close to the rig floor as possible. With the radial distance and angular position set using the primary clamp device of the present invention, the flow line can be extended along the length of the frac head assembly for as long or as short as necessary, thus bringing that rig connection as close to the rig floor as desirable.

In a preferred embodiment of the present invention, the primary clamp apparatus includes one or more integral lock key pockets that firmly secure torsional forces in addition to maintaining the angular position. The torsional forces applied from the flow line are supported by the integral lock keys with the Frac Head assembly but may be supported by various fastening options, including bolts, sleeves, welds, etc. In a preferred embodiment of the present invention, the rating of any of these fastening mechanisms or options must be sufficient to withstand the torsional load that can be induced during hydraulic fracturing operations. The fastening mechanism can be capable of supporting a portion or the entire length of flow line required to reach the rig floor. If only a portion of the length of flow line required is supported by the primary clamping device, multiple clamps may be used, including the Secondary Clamp device of the present invention.

In a preferred embodiment of the present invention, a secondary clamp may be used. The secondary clamp can be used within the frac head assembly or not within the frac head assembly. The secondary clamp can be used in addition to the primary clamp apparatus of the present invention. In a preferred embodiment of the present invention, the secondary clamp may be used as a single clamp below the primary clamp or in multiple depending on the land out distance and amount of flow line required within the assembly to bring the lowest connection within a safe working distance to the rig floor. In a preferred embodiment of the present invention, the secondary clamp attaches to the flow line in a way similar to how the primary clamp attaches to the flowline. Preferably, the secondary clamp also connects to the exterior surface of the workstring being used during hydraulic fracturing operations. In a preferred embodiment of the present invention, the secondary clamp stabilizes gravitational forces and related momentary forces. The secondary clamp can also allow the flow line to rigidly fasten to drill pipe or other workstrings, extending along the length of the workstring to the desired distance to the rig floor.

The primary and secondary stabilization clamp(s) of the present invention may be installed in the shop or in the field at the wellsite. The clamp(s) may be installed with the flowline secured or positioned prior to flow line installation.

In various preferred embodiments of the present invention, the clamps (including primary and secondary clamps) can be made of steel, ferrous alloys, non-ferrous alloys, composite materials capable of supporting the flow line and corresponding to forces seen during hydraulic fracturing operations. In a preferred embodiment of the present invention, support gussets/features or a multiple of support gussets/features are not fastened or assembled to the clamps so that mechanical integrity is guaranteed. (Alternative embodiments of the present invention include gussets/features that are fastened or assembled to the clamps.)

In a preferred embodiment of the present invention, assembly of the clamp and clamp components can be done using bolting, welding, or other fastening mechanisms and can be based on the material composition and the individual application's technical requirement, including vibration, torsion, tension, pressure, temperature, flow rate, fluid density, government regulation, industry regulation, etc.

In a preferred embodiment of the present invention, the Primary Clamp includes lock key pockets. In order to secure the torsional forces of the assembly, the Frac Head Assembly can have mating lock keys and lock key pockets within the principal members. The mating features of these lock key pockets can also serve as alignment features for the high-pressure valves.

In a preferred embodiment of the present invention, both the primary clamp device and the secondary clamp device can include at least two clamp segments, one attaching to the flow line and the other attaching to the workstring or the Frac Head Body/Assembly. Besides the clamp segments, both the primary clamp and secondary clamp can each include one or more beam flanges (similar to an I-beam flange) and a beam web. These beam components aid with the clamp position and set the necessary radial distance, flow line axis to frac head axis. Each clamp component can be welded together making a weldment assembly or can be machined or fabricated from single piece stock or molded/cast. In a preferred embodiment of the present invention, each clamp device can have a mechanism to secure it to the flow line, workstring, or frac head assembly and may include bolts or cam devices. Each clamp can be fabricated from steel plate but may be made from other ferrous or even non-ferrous metallic or plastics, composites, or natural materials. In a preferred embodiment of the present invention, the size and shape of each clamp is capable of supporting the loaded parameters of the hydraulic fracturing operations with appropriate margins of safety.

In one or more preferred embodiments of the present invention, a hydraulic fracturing apparatus is comprised of a tool body; a work string connected to and is that depending downwardly from the tool body; a flowline spaced laterally away from the tool body and work string; a clamp body that has a first end and a second end, with the first end spaced away from the second end; a first clamp segment located at the first end of the clamp body, wherein the first clamp segment has a fastening mechanism and a first concave member; a second clamp segment located at the second end of the clamp body that has a second concave member; wherein the first clamp segment is sized and shaped to engage the tool body, the second clamp segment is sized and shaped to engage the flow line; the clamp body has a pair of spaced apart flanges connected by a web, wherein each of the flanges and the web connects to each of the first and second concave members; each concave member has opposed slotted or apertured plates; third and fourth concave members connected to a said first or second concave member in a connected position that connects the first clamp segment and the first concave segment to the tool body and work string and connects the second clamp segment and second concave member to the flow line; and wherein each concave member is fitted with a pair of opposed slotted or aperture plates.

In one or more preferred embodiments of the present invention, the fracturing apparatus further comprises the flow line as generally parallel to the tool body.

In one or more preferred embodiments of the present invention, the fracturing apparatus further comprises one or more gussets located on the clamp body, wherein each gusset connects a flange to a concave member.

In one or more preferred embodiments of the present invention, the fracturing apparatus further comprises one or more gussets located on the first end of the clamp body.

In one or more preferred embodiments of the present invention, the fracturing apparatus further comprises one or more gussets positioned to stabilize the clamp apparatus when the apparatus is fastened to the tool body and the flow line.

In one or more preferred embodiments of the present invention, the fracturing apparatus further comprises one or more of the gussets having a lift eye.

In one or more preferred embodiments of the present invention, the fracturing apparatus further comprises one or more gussets to help stabilize the clamp apparatus when the apparatus is fastened around or clamped to the tool body and the flow line.

In one or more preferred embodiments of the present invention, the fracturing apparatus further comprises slotted or apertured plates on the first concave member that are generally co-planar.

In one or more preferred embodiments of the present invention, the fracturing apparatus further comprises a first clamp segment that has one or more lock key pockets.

In one or more preferred embodiments of the present invention, the fracturing apparatus further comprises one or more lock key pockets and lock keys that secure the tool body to the clamp body.

In one or more preferred embodiments of the present invention, the fracturing apparatus further comprises bolted connections that secure one concave member to another concave member.

In one or more preferred embodiments of the present invention, the fracturing apparatus further comprises the slotted or apertured plates of the first clamp segment forming an acute angle with the slotted or apertured plates of the second clamp segment.

In one or more preferred embodiments of the present invention, the fracturing apparatus further comprises the one or more gussets helping to stabilize the clamp apparatus at the slotted or apertured plates when the apparatus is fastened to the tool body and the flow line.

In one or more preferred embodiments of the present invention, a hydraulic fracturing apparatus is comprised of an elongated well string that includes a tool body; a flowline spaced laterally away from the well string; a clamping apparatus that connects to both the well string and the flowline, wherein the clamping apparatus includes a clamp body that has first and second clamp body end portions with each clamp body end portion configured to engage and connect with the well string or the flowline; a first clamp segment located at the first end of the clamp body, wherein the first clamp segment has a fastening mechanism and a concave member; a second clamp segment located at the second end of the clamp body, wherein the second clamp segment has a concave member; wherein the first clamp segment is sized and shaped to engage the tool body and the second clamp segment is sized and shaped to the flow line; wherein the clamp body has a pair of spaced apart flanges connected by a web, with each flange and web connecting to each concave member; wherein each concave member has opposed slotted or apertured plates; and wherein there are third and fourth concave members that are each connectable to a said first or second concave member with a bolted connection.

In one or more preferred embodiments of the present invention, the fracturing apparatus further comprises the flow line as being generally parallel to the tool body.

In one or more preferred embodiments of the present invention, the fracturing apparatus further comprises one or more gussets located on the clamp body, with each gusset connecting a flange to a concave member.

In one or more preferred embodiments of the present invention, the fracturing apparatus further comprises one or more gussets are located on the first end of the clamp body.

In one or more preferred embodiments of the present invention, the fracturing apparatus further comprises one or more of the gussets having a lift eye.

In one or more preferred embodiments of the present invention, the fracturing apparatus further comprises slotted or apertured plates that are generally co-planar.

In one or more preferred embodiments of the present invention, the fracturing apparatus further comprises a first clamp segment that has one or more lock key pockets and locks that interface with the pockets.

In one or more preferred embodiments of the present invention, a hydraulic fracturing apparatus comprises an elongated well string that includes a tool body; a flowline spaced laterally away from the well string; a clamping apparatus that connects to both the well string and the flowline, the clamping apparatus including a clamp body having first and second clamp body end portions; with each clamp body end portion configured to engage and connect with the well string or flowline; a first clamp segment located at the first end of the clamp body, wherein the first clamp segment has a fastening mechanism and a first concave member; a second clamp segment located at the second end of the clamp body that has a second concave member; wherein the first clamp segment is sized and shaped to engage the well string and the second clamp segment is sized and shaped to engage the flow line;

wherein the clamp body has a pair of spaced apart flanges connected by a web, each of the flanges and the web connecting to each of the first and second concave members, with each concave member having opposed slotted or apertured plates; third and fourth concave members that are each connectable to a said first or second concave member; and wherein the first concave member has a radius of curvature that is larger than the radius of curvature of the third and fourth concave members.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
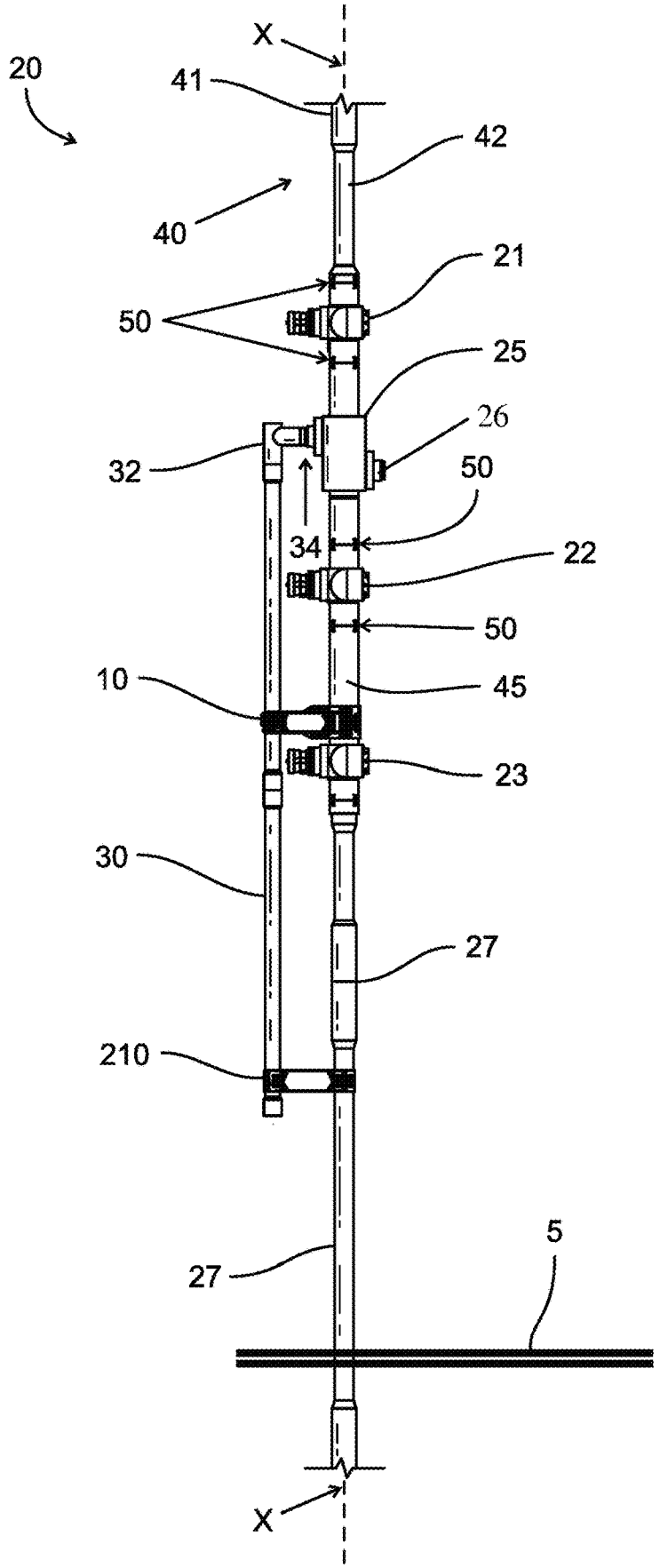
FIG. 1 is a side view of a typical offshore hydraulic fracturing or "frac" head assembly including a preferred embodiment of the apparatus of the present invention.
Figure 24:
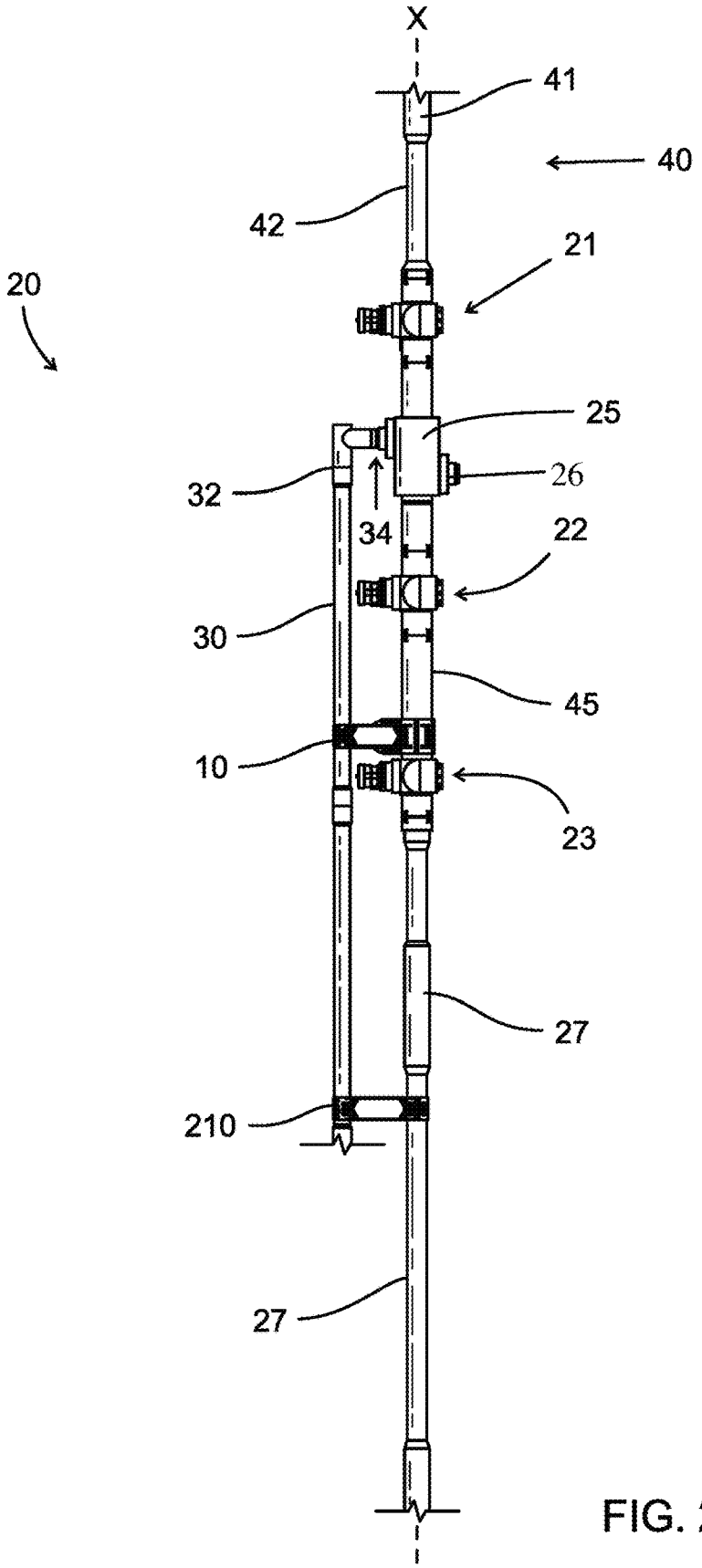
FIG. 24 is a side view of an offshore frac head assembly, including preferred embodiments of the present invention.
Figure 25:
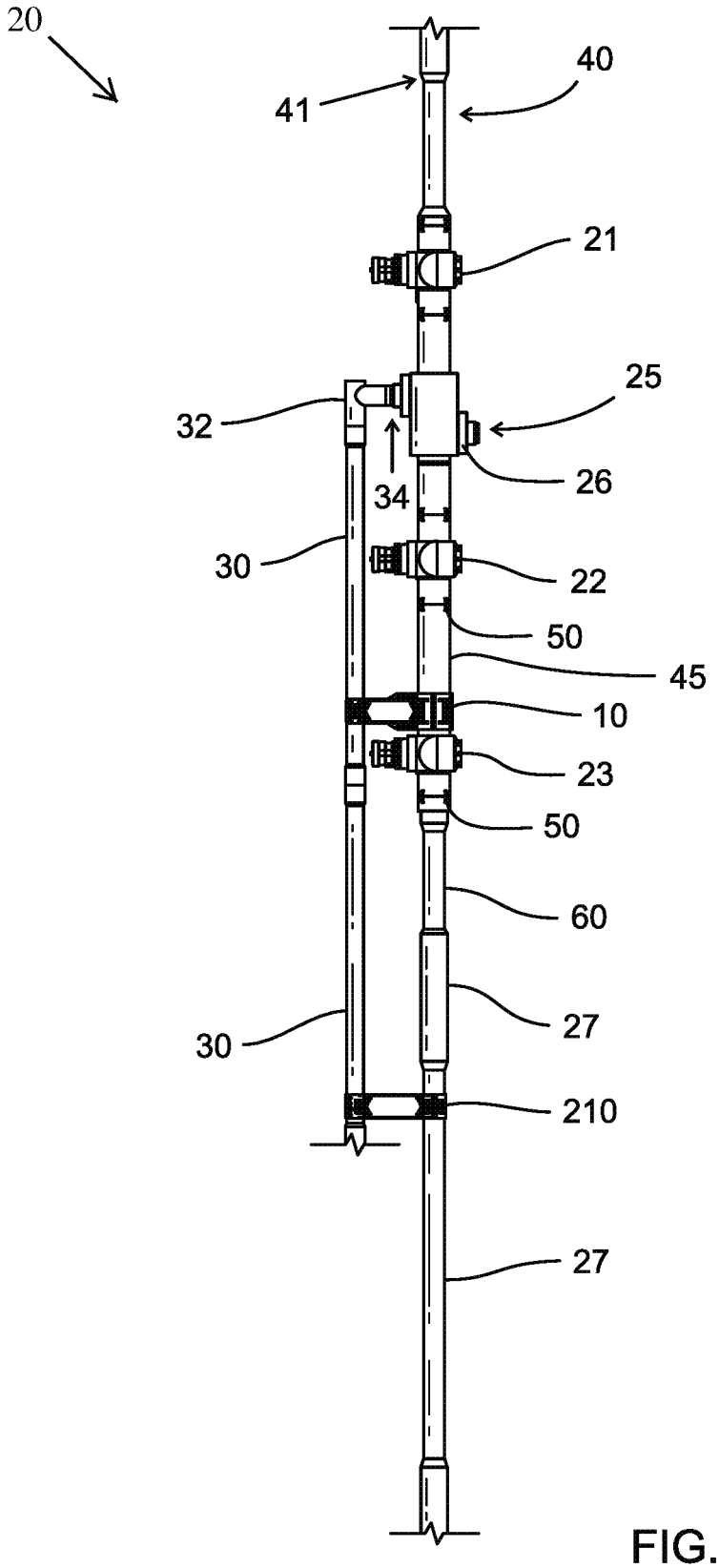
FIG. 25 is a side view of an offshore frac head assembly, including preferred embodiments of the present invention.

FIGS. 1, 24, and 25 show an offshore hydraulic fracturing or fracking tool body, designated generally by the numeral 20. An offshore hydraulic fracturing assembly 20 can include a series of high-pressure valves (first valve 21, second valve 22, third valve 23, as seen in FIGS. 1, 24, and 25) and a multi-inlet flow manifold 25 and workstring 27 that can be in line with high-pressure valves 21, 22, 23. Workstring 27 can have varying diameters, as shown in FIGS. 1 and 24.

In a preferred embodiment, manifold 25 has one (1) or two (2) flow lines 30 attached to it. It is possible to have more than two flow lines attached to manifold 25, though, such as four (4). In an alternative embodiment, manifold 25 has six (6) ports for flow lines that clamp apparatus 10, 210, 410 can connect to. Factors that limit the number of ports on manifold 25 include cost, practicality, and the need for a certain amount of fluid/pressure. Manifold 25 can be commercially available and manufactured by Gulfstream Services, Inc., for example, or from ASAP Machine Shop and Machine Shop Services. Manifold 25 can be of a configuration different from that shown in FIG. 1. Manifold 25 can be a general "cross" shape or can be a "goat head" shape, for example. In a preferred embodiment (as shown in FIGS. 1, 24, and 25), flow line 30 can attach to or be connected to manifold 25 with flow line adapter 34 and elbow 32. Elbow 32 can preferably have an angle of about 90 degrees. If only one flow line 30 is to be connected to manifold 25, blind flange or cap 26 can be placed on the other or second outlet of manifold 25 that is not connected to an additional flow line (see FIGS. 1, 9, and 25).

One or more of a series of flow lines (one such flow line 30 is shown in FIGS. 1, 24, and 25) can be attached to additional flow lines or pipes on the well drilling rig floor 5 that connect to a series of pumps through a fracking manifold 25. As shown in FIGS. 1, 24, and 25, flow line 30 and the series of flow lines can be generally parallel to tool body assembly 20 and axis X-X. Offshore hydraulic fracturing assembly 20 can have a configuration that is different from what is shown in FIGS. 1, 24, and 25. Flow line 30 can be used to pump heated water downhole via tool body 20. Such water can be pumped at a pressure value of between about 0 and 15,000 p.s.i. Flow line 30 can also be used to convey, for example, viscosified and non-viscosified water-based fluids, gelled oil-based fluids, alcohol-based fluids, emulsion-based fluids, acid-based fluids, or foam fluids containing dilute acids, carbon dioxide, propellant, biocides, breakers, corrosion inhibitors, crosslinkers, friction reducers, gets, potassium chloride, oxygen scavengers, pH adjusting agents, scale inhibitors, or surfactants.

Figure 26:
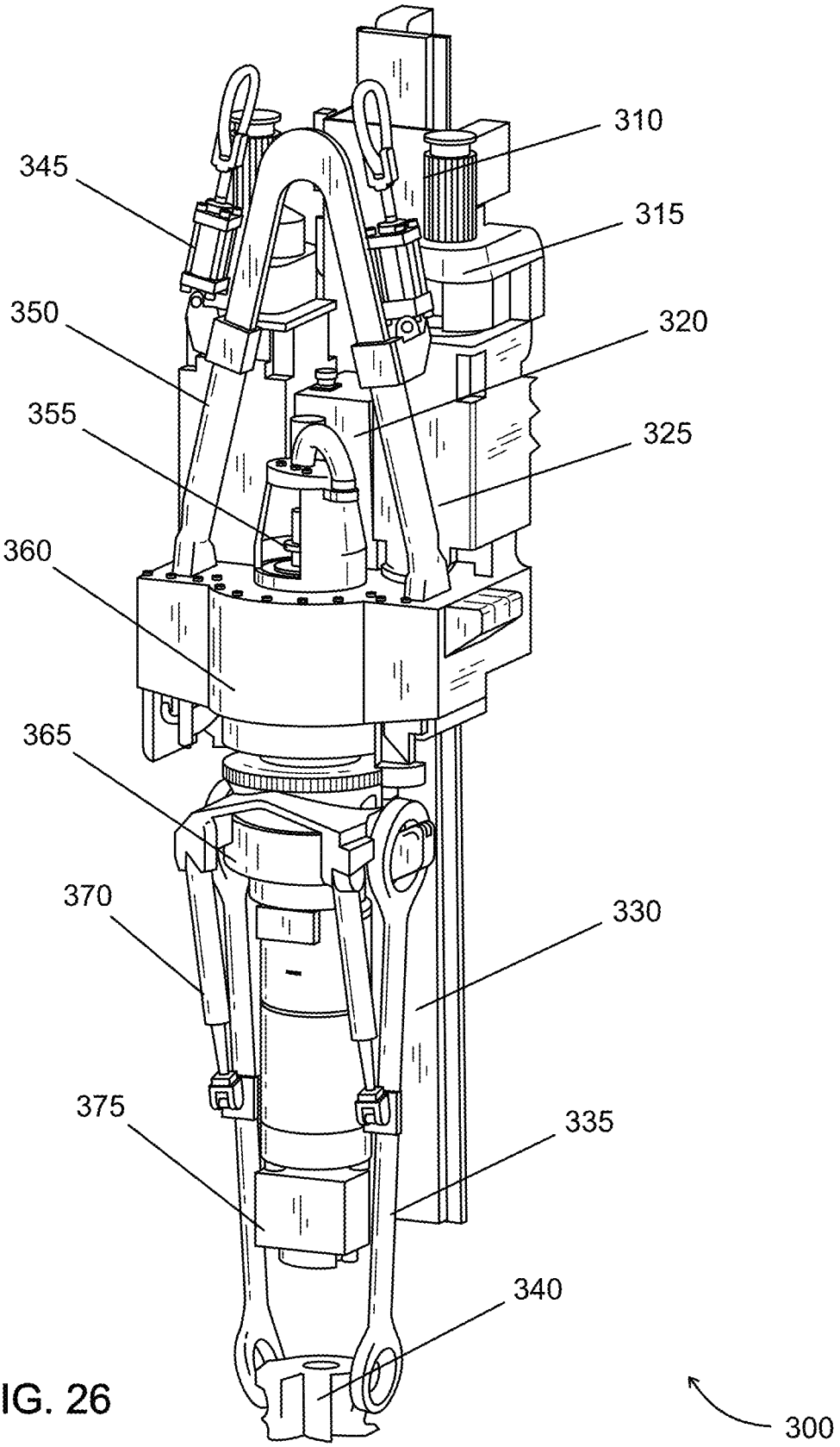
FIG. 26 is a perspective view of a top drive to be used in conjunction with an offshore frac assembly and the apparatus of the present invention.

FIGS. 1, 24, and 25 show top sub or pipe section 40 at the top of assembly 20, wherein top sub or pipe section 40 can include upset feature or component 41 and non-upset feature or component 42. Upset component 41 allows for assembly 20 to be lifted up and suspended within a derrick. Non-upset feature or component 42 of top sub or pipe section 40 can be smaller in diameter than upset feature or component 41 (as shown in FIGS. 1, 24, and 25). Such pipe sections or subs 40 are commercially available. Elevators (shown for example, in FIG. 26, designated by the numeral 340) can latch over top sub or pipe section 40 of frac head assembly 20, which allows assembly 20 to be lifted in line with workstring or drill pipe 27. A top drive (an example of one is shown in FIG. 26, designated generally by the number 300) can be screwed into top sub or pipe section 40 of frac head 20 in case fluid flow is needed through the rig pumps. An elevator clamp can be clamped or secured around the outer surface diameter of upset component 41.

An example of a top drive 300 that can be used with the present invention is shown in FIG. 26 and can include ventilator 310, disk brake 315, tank 320, main motor 325, balance cylinder 345, bail 350, wash pipe assembly 355, gearbox 360, rotating head 365, tilt cylinder 370, back-up tong 375, guide beam 330, link 335, and elevator 340. One skilled in the art of oil well drilling and production industry is familiar with top drives, such as the one shown in FIG. 26, their respective components, and how they work. Such a top drive 300 arrangement is commercially available.

Figure 8:
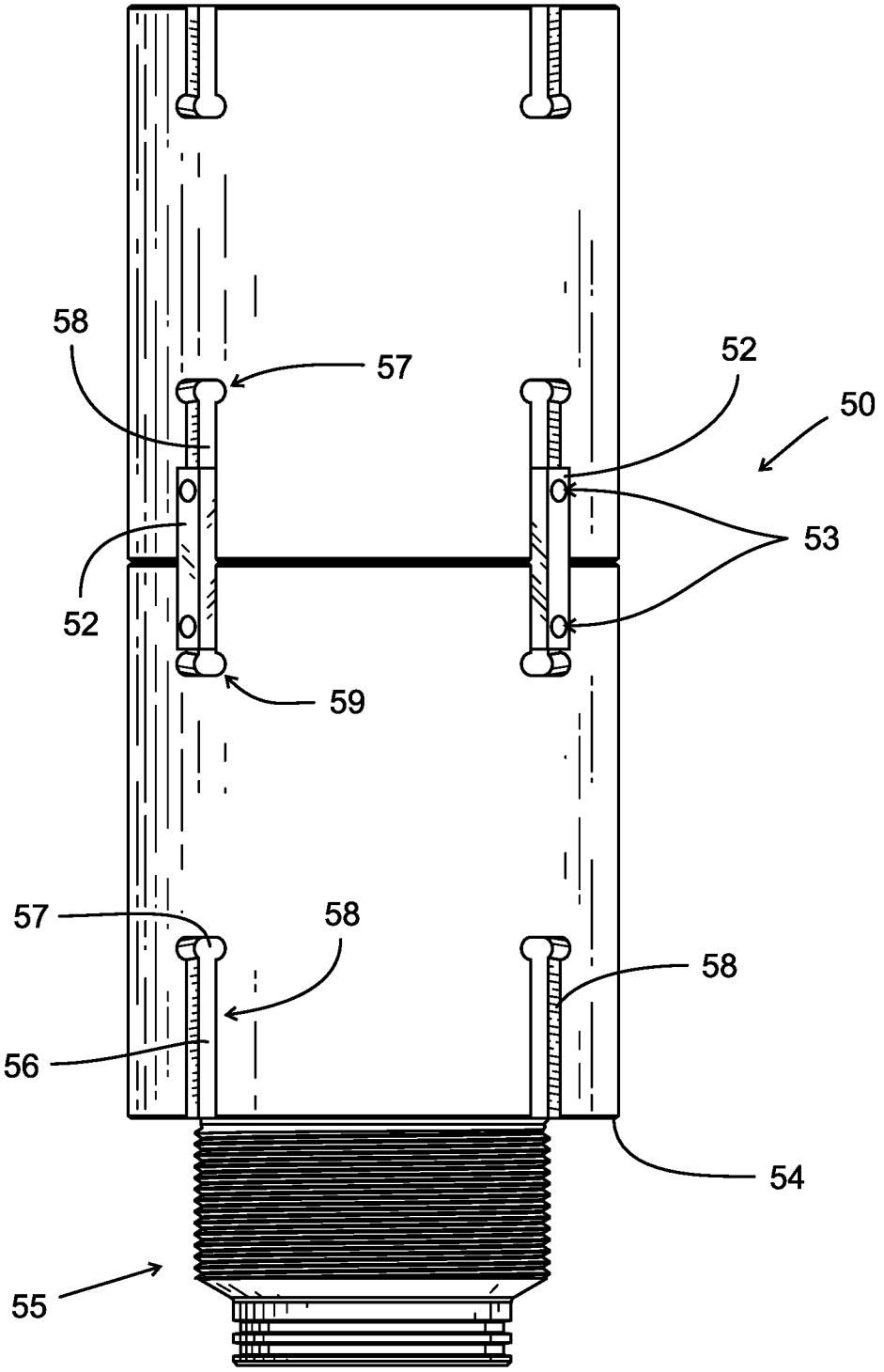
FIG. 8 is a fragmentary view of a preferred embodiment of the apparatus of the present invention showing the lock/torque key portion thereof.

Also shown in FIGS. 1 and 25 on assembly 20 are lock/torque key apparatuses 50 (that are shown in greater detail in FIG. 8). Lock/torque key apparatus 50 aides in the alignment of the different components of frac head assembly 20. In a preferred embodiment, there are key apparatuses 50 around the circumference of assembly 20.

Alignment sub or pipe section 45 can be positioned in between second valve 22 and primary clamp apparatus 10, as shown in FIG. 25. Lock/torque key apparatus 50 can be on second valve 22 and alignment sub or pipe section 45, for example, to engage those two components of tool body 20, such as locking them in place or securing them together. Lock/torque key apparatus 50 can also or alternatively be on third valve 23 and lower sub or pipe section 60 to connect or lock and secure those two components of tool body 20 together. Lock/torque key apparatus 50 can be on additional places of tool body 20, connecting or engaging components other than those mentioned here together.

The bottom of assembly 20 preferably goes through the riser, through the blow-out preventers (BOPs), through the wellhead, into the production casing to the location desired for hydraulic fracturing.

Figure 2:
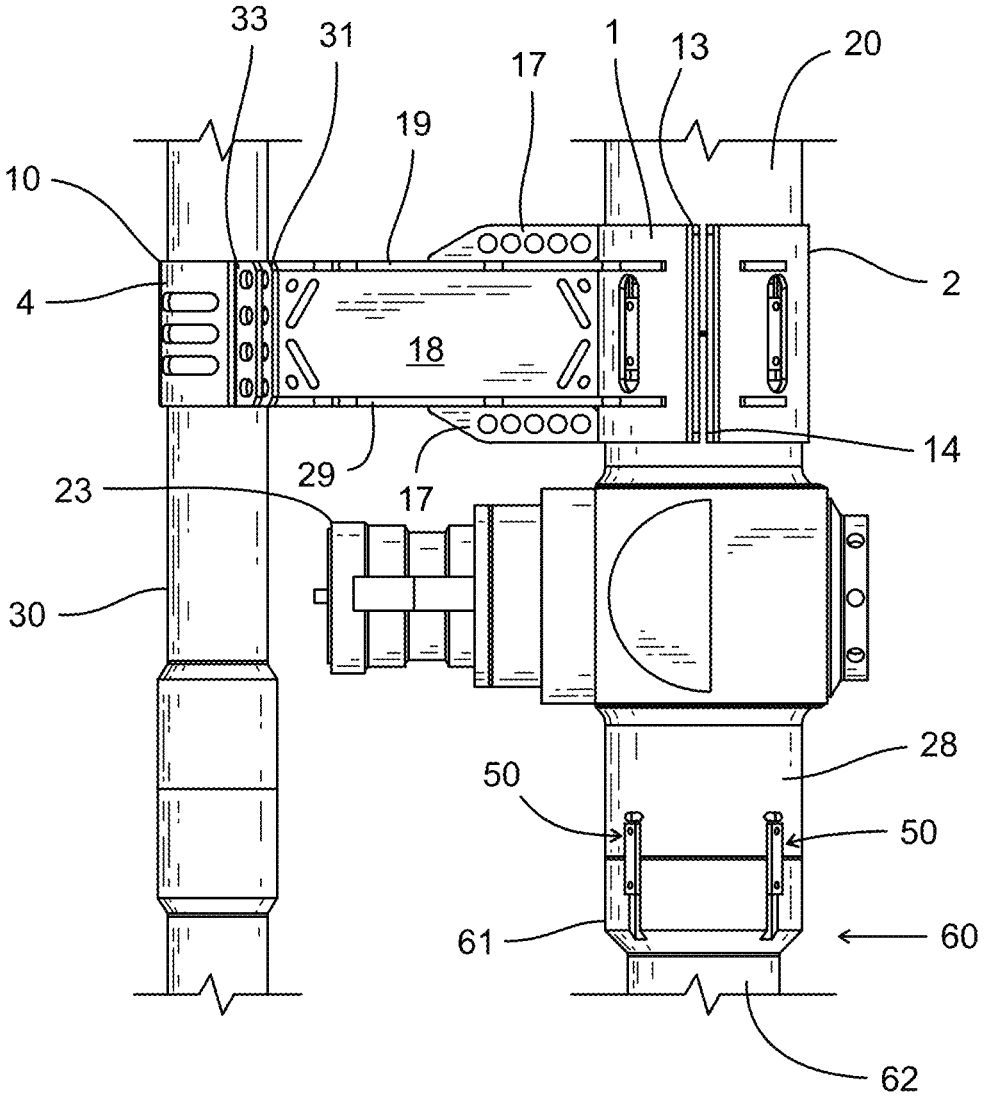
FIG. 2 is a partial side view of a preferred embodiment of the apparatus of the present invention connected to a flow line and tool body.

FIG. 2 shows a partial and enlarged close-up view of part of FIG. 1, specifically valve 23 and primary clamp apparatus 10. Primary clamp apparatus 10 connects to and stabilizes fracking tool body 20 and associated attached flow line 30 (and other flow line(s) that can be connected to flow line 30 and not shown in FIG. 1).

FIG. 2 also shows connection segment or portion 28 of valve body 23. Located below connection segment 28 of valve 23 is lower sub or pipe section 60, which includes upper portion or upset diameter 61 and lower portion or non-upset area 62. In a preferred embodiment, non-upset area 62 is sized and shaped to match the diameter of the drill pipe 27 to aide in handling. FIG. 2 also shows lock/torque key apparatus 50.

Figure 3:
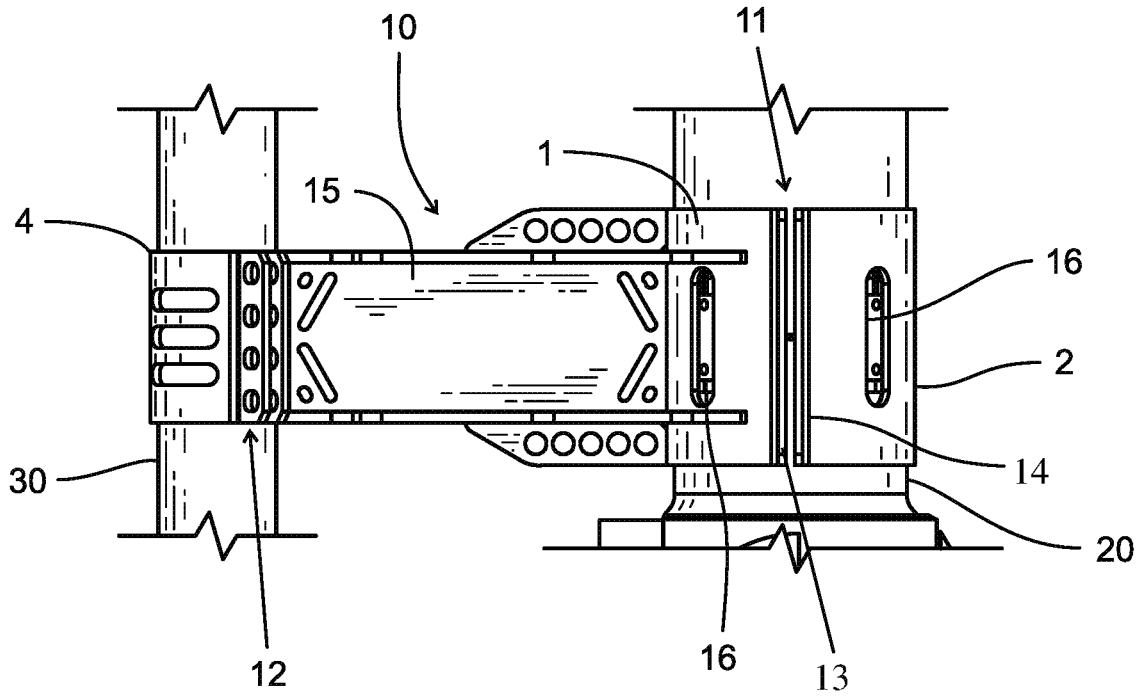
FIG. 3 is a partial side view of a preferred embodiment of the apparatus of the present invention connected to a flow line and tool body.
Figure 4:
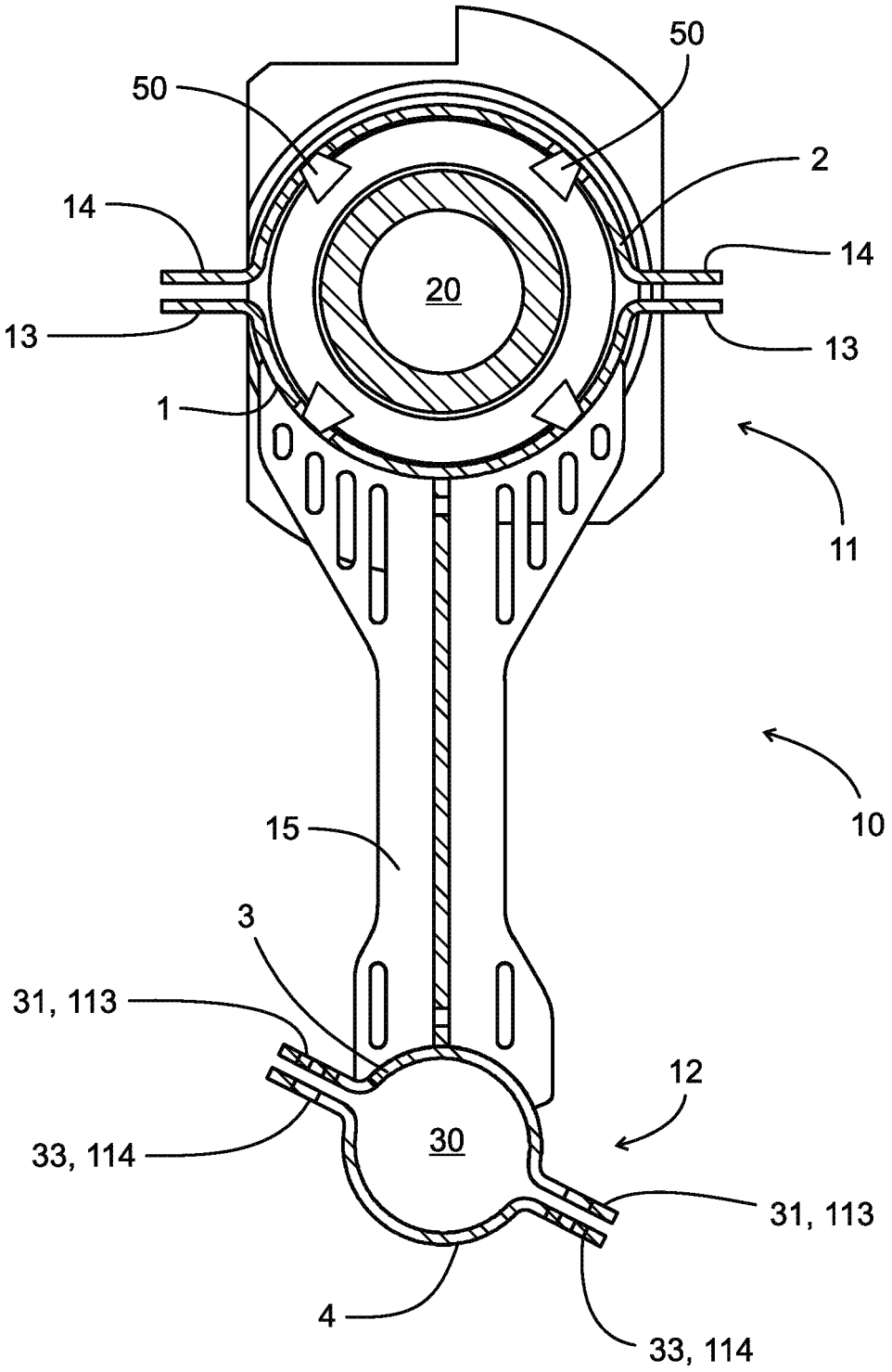
FIG. 4 is a top, cut away view of a preferred embodiment of the apparatus of the present invention.

FIGS. 3 and 4 show a close-up and top, cut away view of primary clamp apparatus 10 connected to tool body 20 and flowline 30. Primary clamp apparatus 10 includes clamp body 15 with first clamp component 11 that is connected to or secured around tool body 20, and second clamp component 12 located spaced away from first clamp component 11 and connected to or secured around flow line 30.

Figure 20:
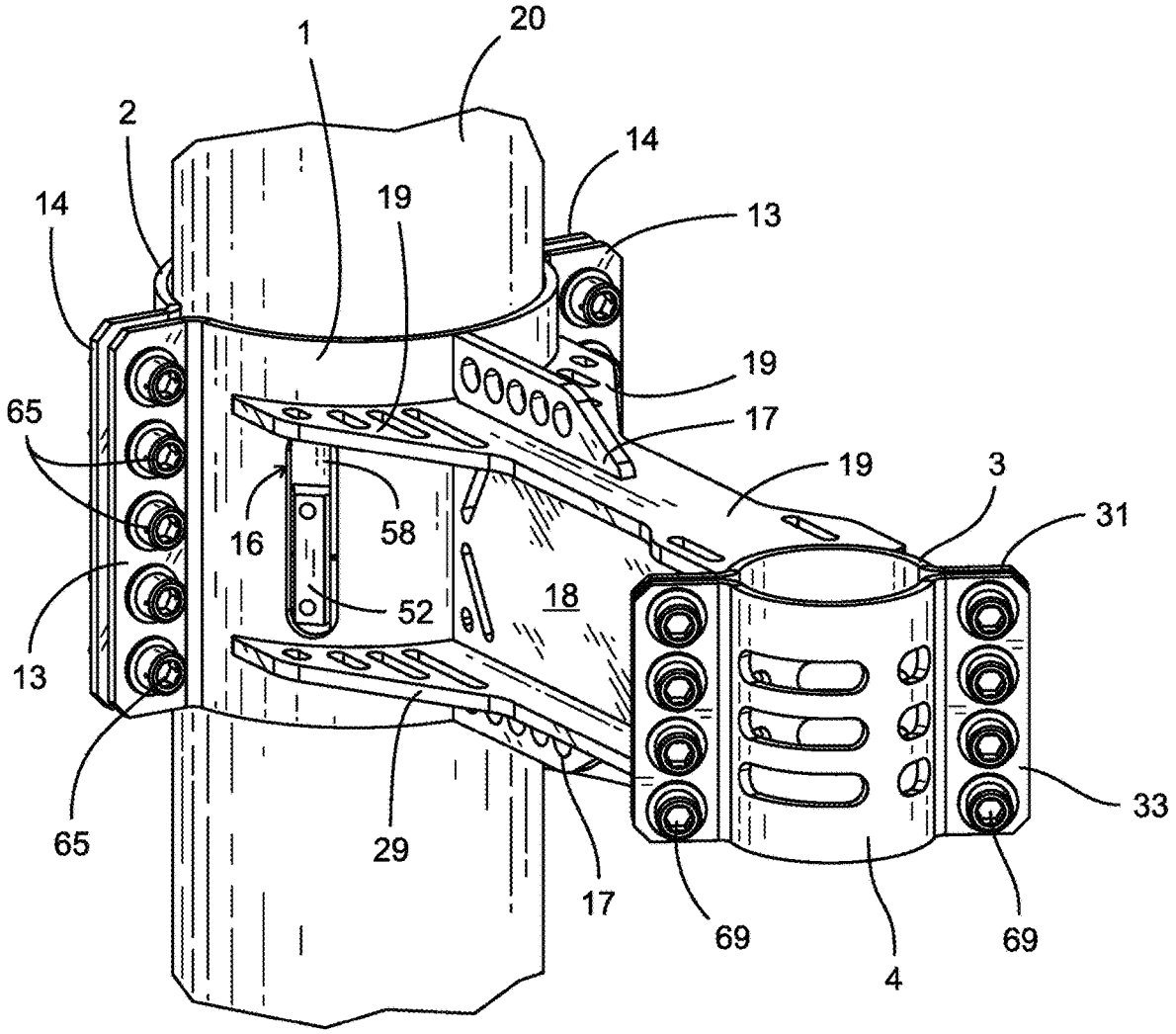
Figure 21:
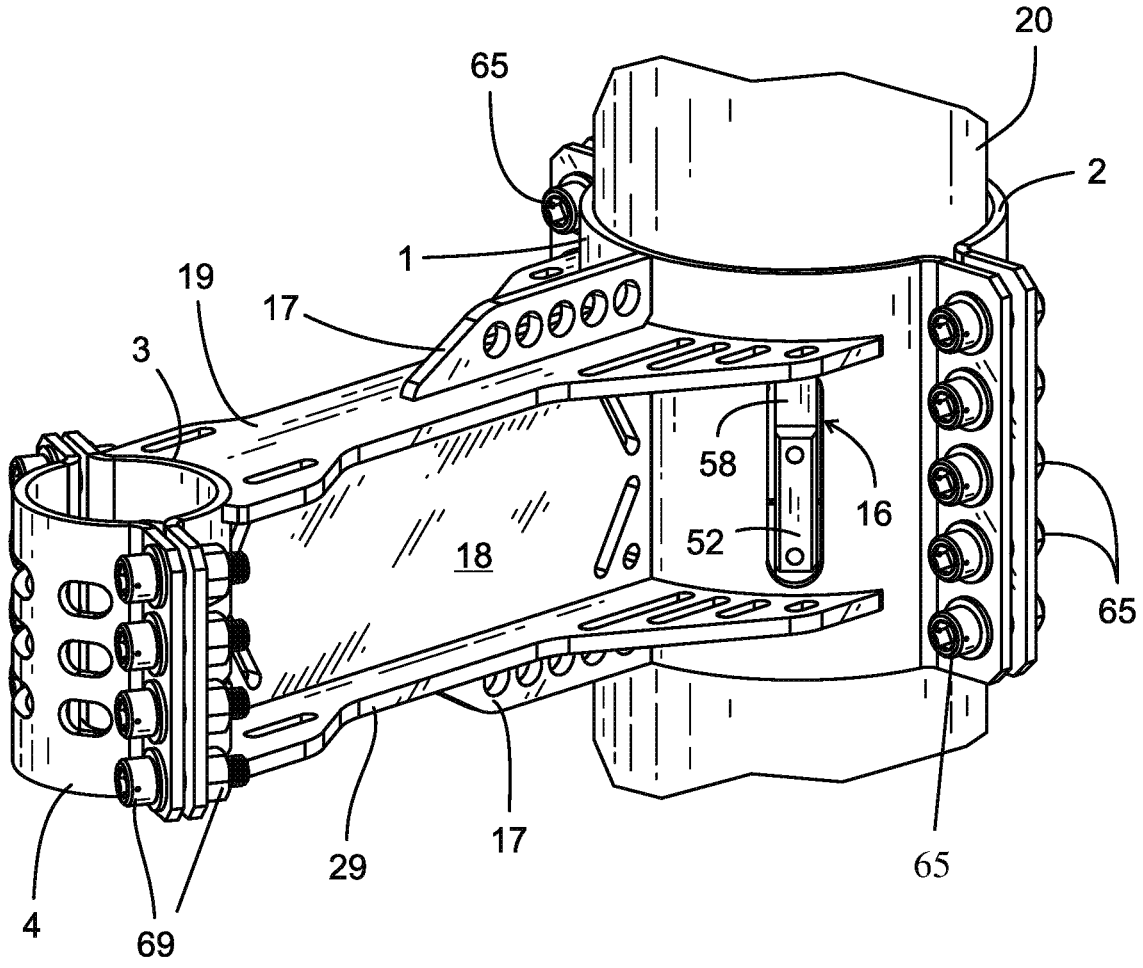
Figure 22:
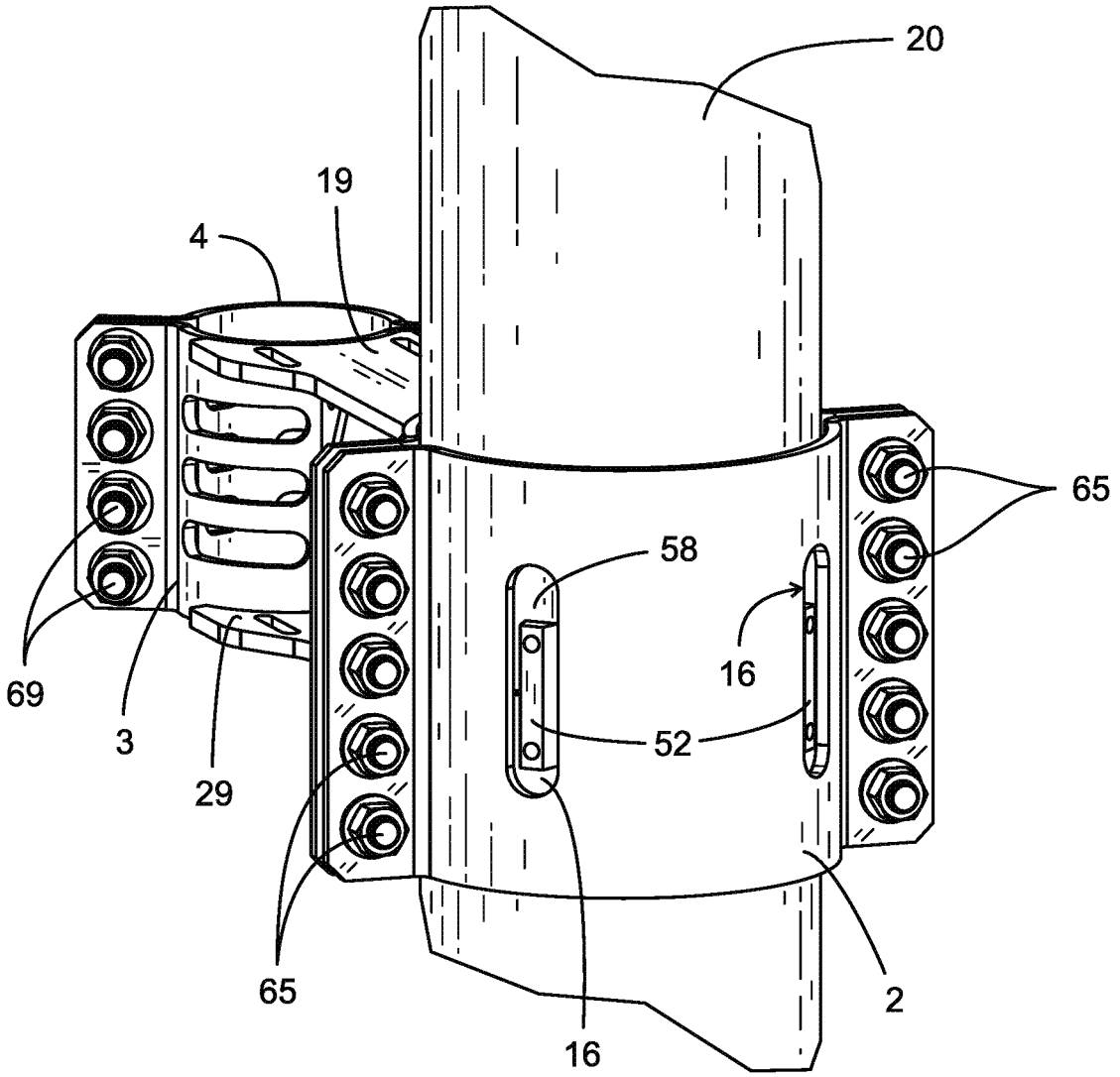
Figure 23:
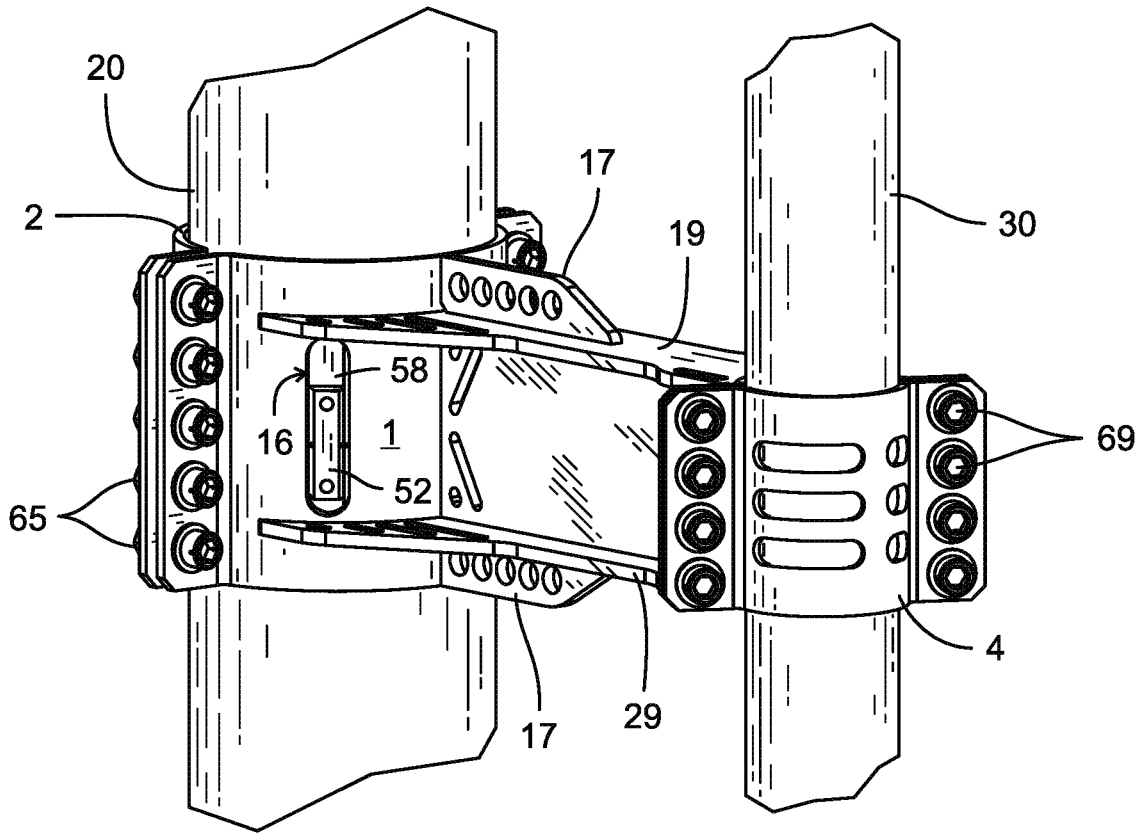

In FIG. 3, first clamp component 11 includes first plate/segment or concave member 1 that is preferably generally U-shaped, and second/corresponding plate or concave member 2 that is also preferably generally U-shaped. The shape of plate or concave member 1 and plate or concave member 2 can vary, but they can mimic each other in shape and size. Plate or concave member 1 also preferably includes fastening plate, clip or slotted/apertured plates 13 on each end of concave member 1 as seen in FIG. 4. Corresponding plate or concave member 2 preferably includes fastening plate, clip or slotted/apertured plates 14 on each end of the general U-shape or concave member as seen in FIGS. 3-4. Fastening plates 14 generally line up with and can mimic fastening plates 13 in size and shape. As seen in FIGS. 19-23, bolted connections 65 can be used to secure concave members 1 and 2 to and/or around tool body 20. In FIG. 20 for example, each slotted or apertured plate 13, 14 has five (5) openings or slots that align for receipt of bolted connections or like fasteners 65. Similarly, concave members 3, 4 can be secured to flow line 30 wherein bolted connections/fasteners 69 are inserted through the aligned slots or openings of slotted or apertured plates 31, 33. Bolted connections/fasteners 65, 69 can be torqued to a desired value (e.g., foot pounds) when securing clamp apparatus 10 to tool body 20 and pipe/flow line 30.

FIG. 4 shows second clamp component 12 that includes first plate/segment or concave member 3 that is preferably generally U-shaped, and second/corresponding plate or concave member 4 that is also preferably generally U-shaped. The shape of plates or concave members 3 and 4 can vary, but they can mimic each other in shape and size. Plate or concave member 3 also includes fastening plate, clip or apertured/slotted plate 31, 113 on each end of the general U-Shape. Plate or concave member 4 also includes fastening plate or clip 33, 114 on each end of the general U-Shape. Fastening plates 31, 113 generally line up with and mimic fastening plates 33, 114 in size and shape.

Primary clamp 10 can include one or more lock key pockets 16 that can be used to secure the flow line circumferential forces, as well as a clamp force capable of securing gravitational forces and momentary forces. In order to secure the torsional forces of the assembly, frac head assembly 20 can have the mating lock keys and dove tail lock pockets within the primary member assembly (shown in FIG. 8, for example). The clamp apparatuses 10, 210, 410 of the present invention can be used without lock key pockets 16 and without one or more lock/torque key apparatuses 50.

The lock key pockets 16 double as alignment features for the high-pressure valves. As shown in FIGS. 2 and 3, in a preferred embodiment, primary clamp 10 maintains the appropriate distance of the flow line 30 in regard to the frac head assembly 20, thus securing the seal face of the corresponding inlet on the manifold body. FIG. 4 shows suggested angular position, distance and torsional loading.

Figure 5:
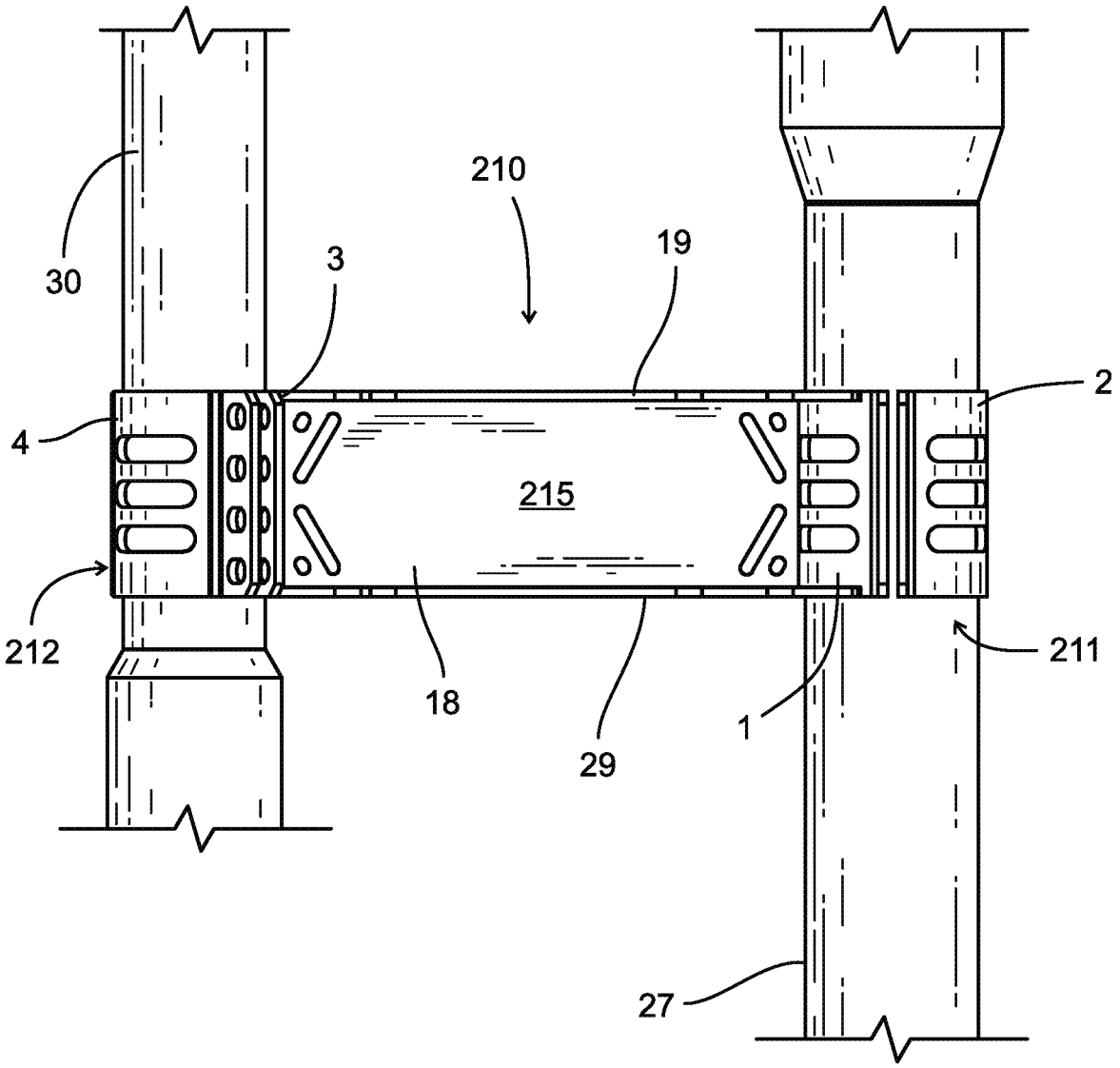
FIG. 5 is a side view of an alternative embodiment of the apparatus of the present invention.

FIG. 5 shows a close-up view of secondary clamp apparatus 210 connected to flowline 30 and the exterior surface of workstring 27. Secondary clamp apparatus 210 includes clamp body 215 with first clamp segment 211 connected to/secured around workstring 27 and second clamp segment 212 locating distally from first clamp segment 211 and connected to/secured around flow line 30. Secondary clamp apparatus 210 can be used as a single clamp preferably below primary clamp apparatus 10 or more than one secondary clamp apparatus 210 can be used depending on the land out distance and amount of flow line 30 required within assembly 20 to bring the lowest connection within a safe working distance to the rig floor. In a preferred embodiment, secondary clamp apparatus 210 does not include lock key pockets (but in alternative embodiments, secondary clamp apparatus 210 can include lock key pockets). Secondary clamp apparatus 210 stabilizes gravitational forces and related momentary forces. Secondary clamp apparatus 210 can allow flow line 30 to rigidly fasten directly to drill pipe or other workstrings, extending along the length of workstring 27 to the desired distance to the rig floor.

Figure 6:
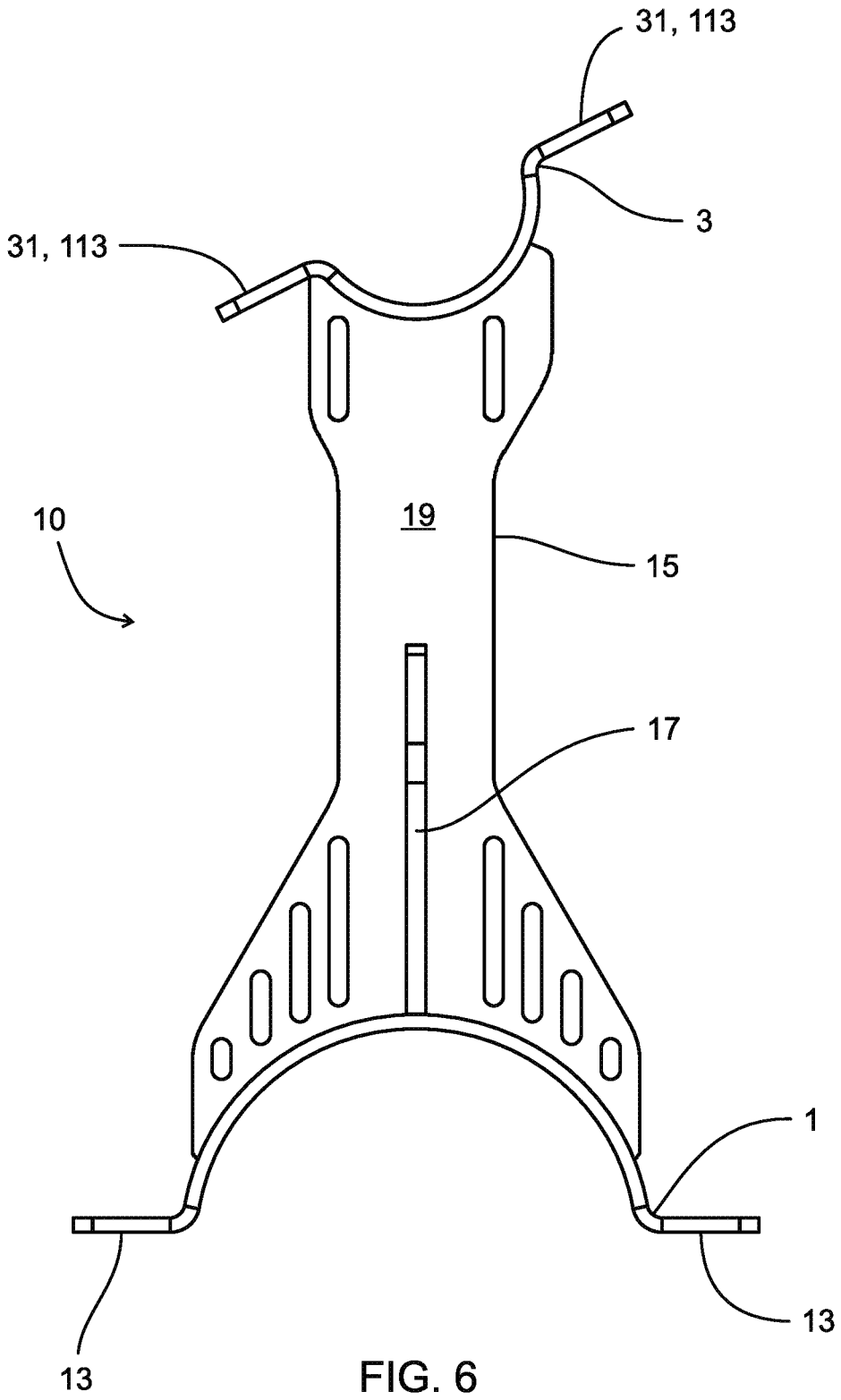
FIG. 6 is a partial top view of a preferred embodiment of the apparatus of the present invention.
Figure 7:
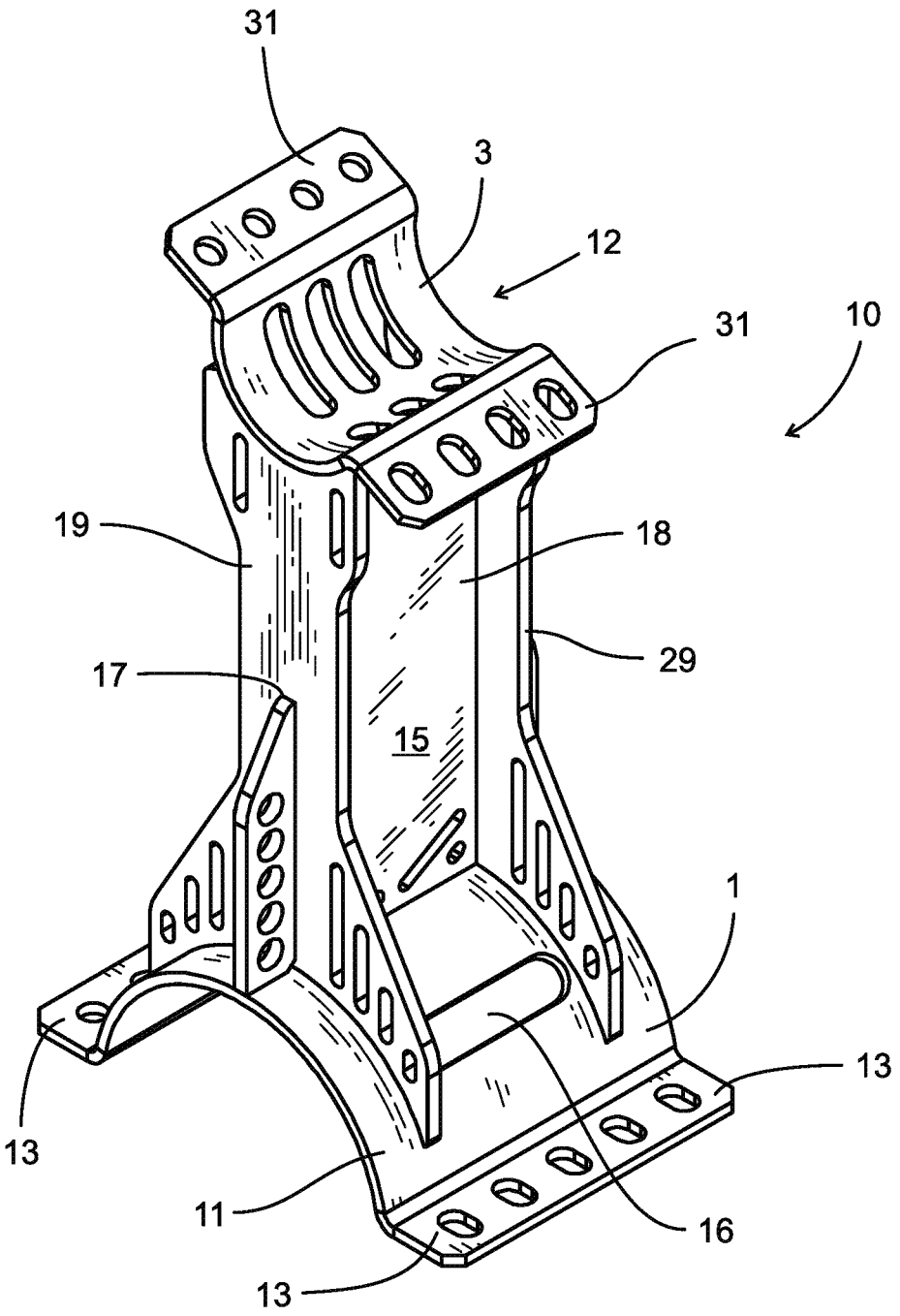
FIG. 7 is a partial perspective view of a preferred embodiment of the apparatus of the present invention.

FIGS. 6 and 7 show other close up views of primary clamp apparatus 10 with clamp body 15, with FIG. 6 showing a side or top view of clamp 10 and FIG. 7 showing a perspective view of clamp 10. Clamp segment 11 is located at one end of clamp body 15, and clamp segment 12 is located at the other end of clamp body 15 with web 18 serving as the connection between segments 11 and 12. Clamp body 15 also preferably includes upper flange 19 and lower flange 29. Clamp segment 11 can connect to/be secured around or to tool body 20, and clamp segment 12 can connect to/be secured around or to flow line 30. Also seen in FIG. 7 is lock key pocket 16 (of which there can be another lock key pocket on the other side of body 15 that is not shown). Gusset 17 can also be seen in FIG. 7, which provides support, stabilization, and structural integrity. Gusset 17 can also operate as a lift point or handling point. FIGS. 6 and 7 also show fastening mechanisms or clips 13.

FIG. 8 shows a preferred embodiment of lock/torque key apparatus of the present invention, designated generally by the numeral 50. In a preferred embodiment, lock/torque key apparatus 50 includes sliding portion or lock key protrusion 52 and indentation or lock key pocket 58. Lock key protrusion 52 can be secured to pocket 58 with one or more screws 53 (as seen in FIG. 8) once protrusion 52 is in the position the user intends it to be in. Screws 53 can be unscrewed to move protrusion 52. In a preferred embodiment, protrusion 52 can move in a coaxial direction to tool body 20 in order to either create interference or to remove the interference; this depends on whether there is a need to apply torque through the connection or to disassemble tool body 20 altogether. In a preferred embodiment, pocket 58 can be longer than the length of lock key or sliding portion 52. Each end 57, 59 of pocket 58 can be slightly wider than the width of the main portion 56 of pocket 58. The presence of lock keys 52 and lock key pockets 58 on frac head assembly 20 aides in securing torsional forces of assembly 20. If one or more clamp apparatuses 10, 210, 410 are used, key or sliding portion 52 can be sized and shaped to fit within lock key pocket 16 of the clamp apparatus. Lock/torque keys 50 can be located on various parts of assembly 20. Threaded connection 55, seen in FIG. 8, is a typical connection between and can secure various parts/subs/sections of assembly 20. Once threaded together or secured, two various parts/subs/sections of assembly 20 meet at connection shoulder 54. In a preferred embodiment, one end 57 of pocket 58 is located on one part or section of assembly 20, and the other end 59 of pocket 58 is located on the other part of section of assembly 20 that is being connected to the first part or section of assembly 20. When the two parts or sections are connected or secured, it creates one or more continuous pockets 58 that a lock key protrusion 52 can fit into.

FIG. 8 shows two sections of tool body 20. Lock/torque key assemblies 50 can be used on a variety of, if not every, section of tool body 20 to connect with another section of tool body 20. There are other assemblies of sections of tool body 20 that can be used with a preferred embodiment of the present invention that are not shown in the figures (i.e., the assemblies of sections that make up tool body 20 that are shown in the figures are not meant to limit the possibilities of how tool body 20 can be assembled with different sections and used with the apparatus of the present invention). Examples of tool body 20 connections between sections that lock/torque key assemblies 50 can be used on include: top sub 40 and valve 21, 22 23 (or any additional valve(s) that are not shown); top sub 40 and flow manifold 25; top sub 40 and alignment sub 45; top sub 40 and bottom or lower sub 60; top sub 40 and quick union; valve 21, 22, 23 (or any additional valve(s) and valve 21, 22, 23, (and any additional valve(s)), valve 21, 22, 23 (or any additional valve(s)) and flow manifold 25; valve 21, 22, 23 (or any additional valve(s)) and alignment sub 45; valve 21, 22, 23 (or any additional valve(s)) and bottom sub 60; valve 21, 22, 23 (or any additional valve(s)) and quick union; flow manifold 25 and flow manifold 25; flow manifold 25 and alignment sub 45; flow manifold 25 and bottom sub 60; flow manifold 25 and quick union; alignment sub 45 and alignment sub 45; alignment sub 45 and bottom sub 60; alignment sub 45 and quick union; quick union and quick union; and quick union and bottom sub 60.

Figure 9:
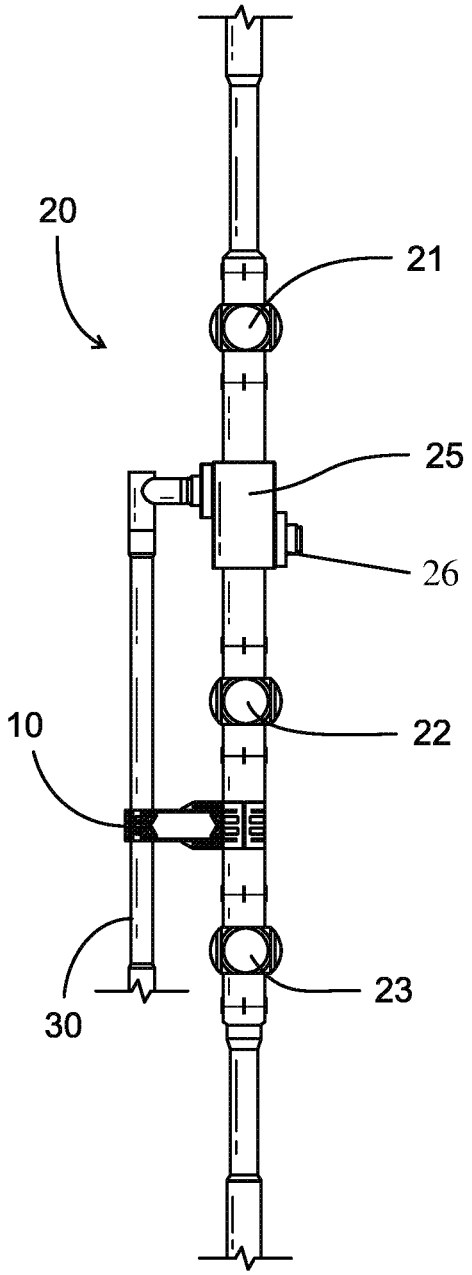
FIG. 9 is a side view of an offshore frac head assembly, including preferred embodiments of the present invention.
Figure 10:
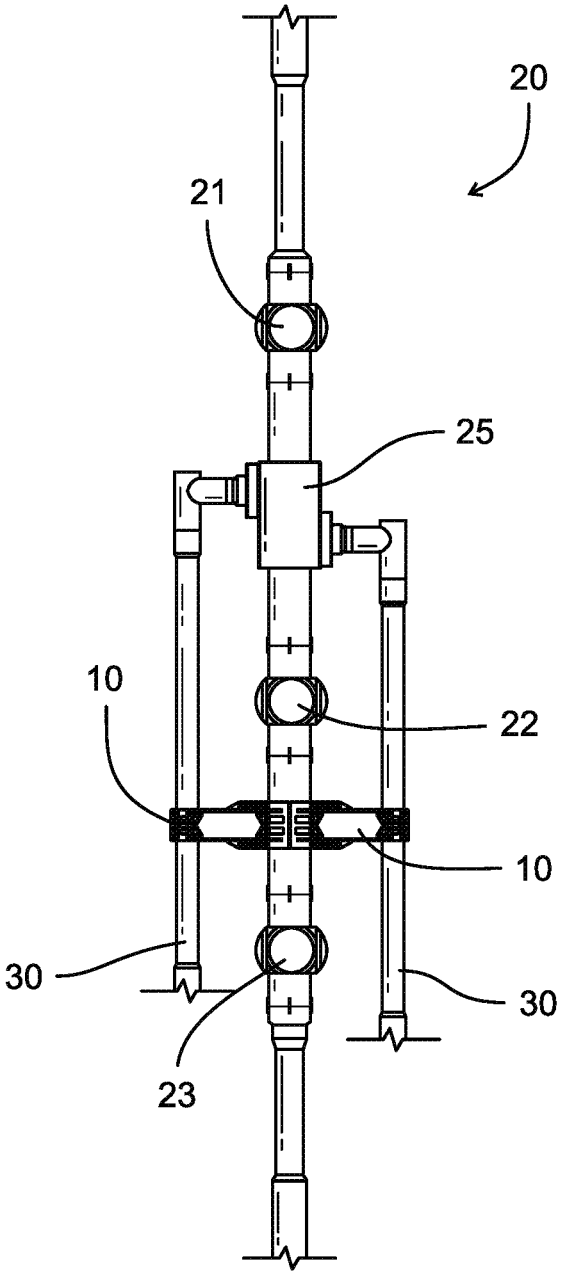
FIG. 10 is a side view of an offshore frac head assembly, including preferred embodiments of the present invention.
Figure 11:
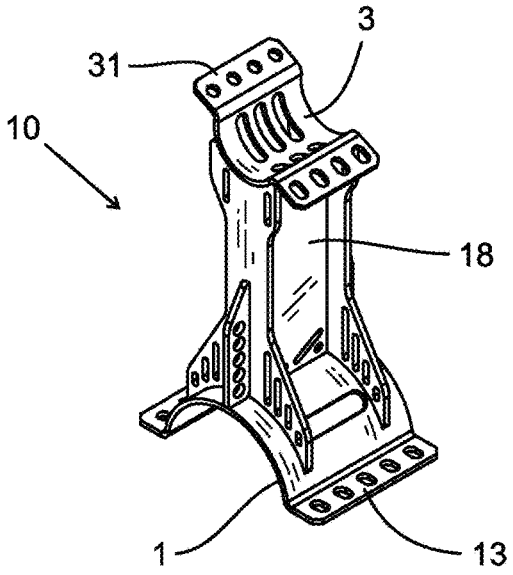
FIG. 11 is a partial perspective view of a preferred embodiment of the apparatus of the present invention showing the clamp.
Figure 12:
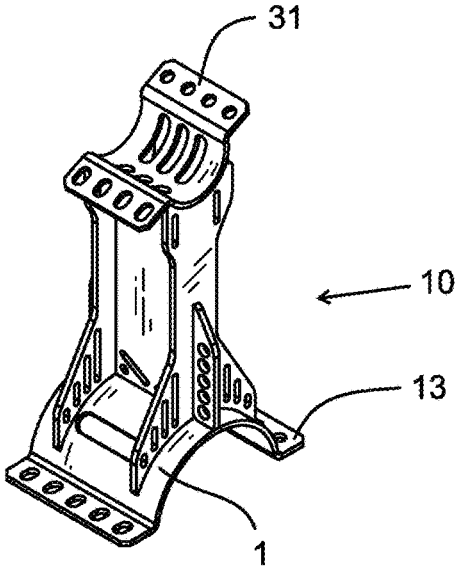
FIG. 12 is a partial perspective view of a preferred embodiment of the apparatus of the present invention showing the clamp.
Figure 13:
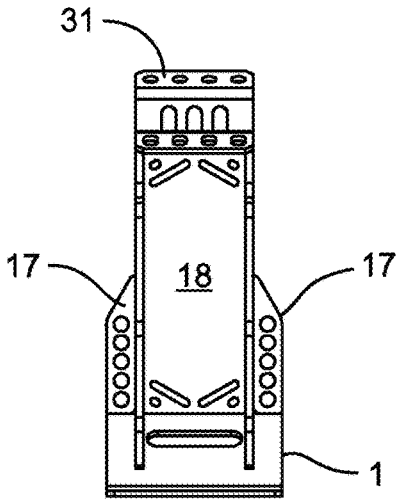
FIG. 13 is a partial elevation view of a preferred embodiment of the apparatus of the present invention showing the clamp.
Figure 14:
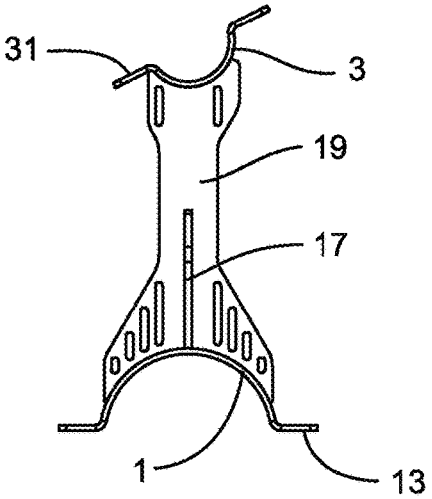
FIG. 14 is a partial elevation view of a preferred embodiment of the apparatus of the present invention showing the clamp.
Figure 15:
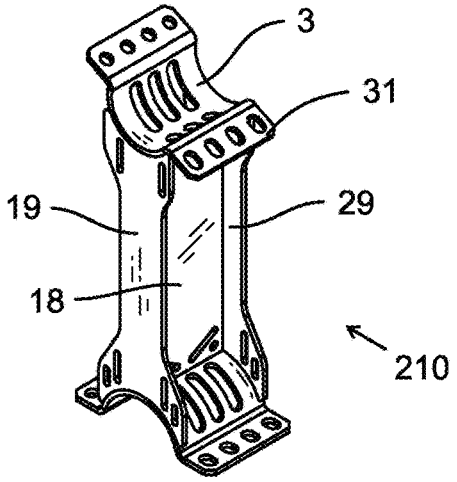
FIG. 15 is a partial perspective view of an alternative embodiment of the apparatus of the present invention showing the clamp.
Figure 16:
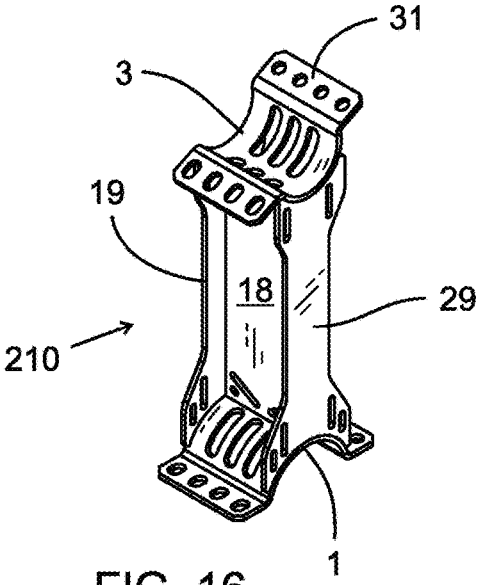
FIG. 16 is a partial perspective view of an alternative embodiment of the apparatus of the present invention showing the clamp.
Figure 17:
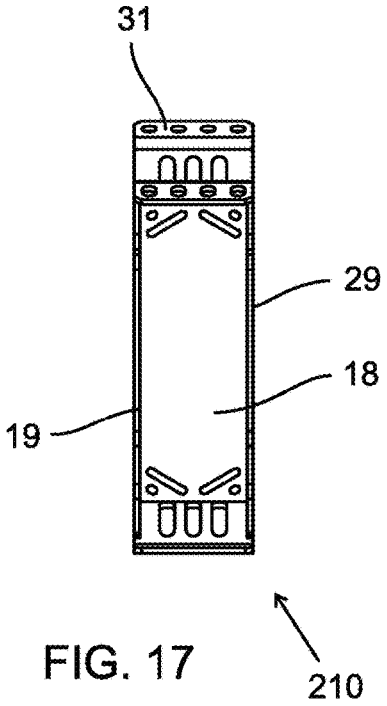
FIG. 17 is a partial elevation view of an alternative embodiment of the apparatus of the present invention showing the clamp.
Figure 18:
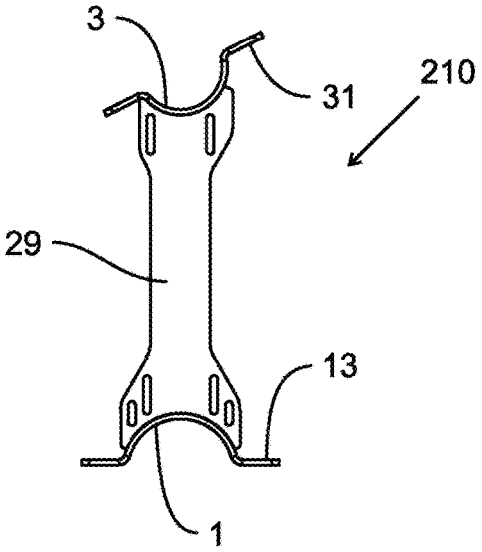
FIG. 18 is a partial elevation view of an alternative embodiment of the apparatus of the present invention showing the clamp.
Figure 19:
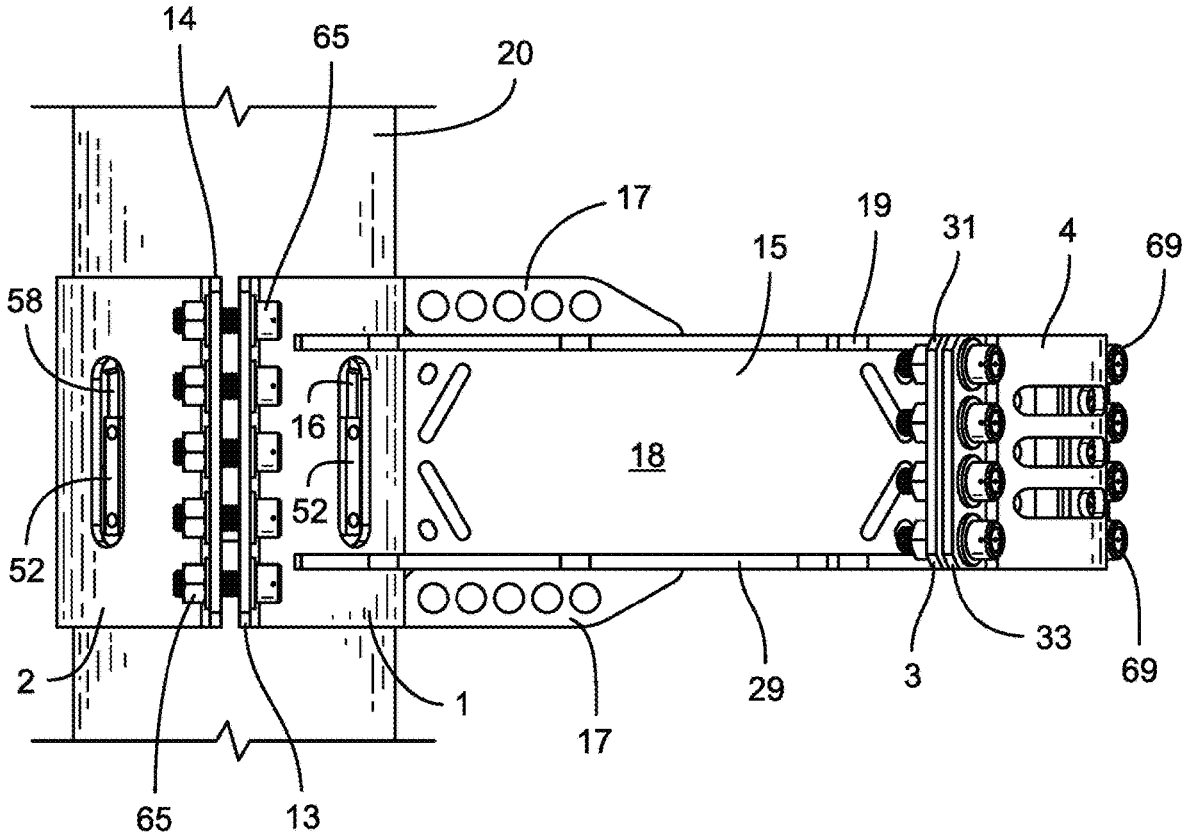
FIGS. 19-23 show various views of a preferred embodiment of the apparatus of the present invention showing the clamp.

FIGS. 9 and 10 show various offshore frac head assemblies or fracking tool bodies, designated generally by the numeral 20. An offshore frac assembly 20 can include a series of high-pressure valves (first valve 21, second valve 22, third valve 23) and multi-inlet flow manifold 25 in line with high-pressure valves 21, 22, 23. A series of flow lines 30 can be attached to additional flow lines or pipes on the rig floor that connect to a series of pumps through frac manifold 25. As shown in FIGS. 9 and 10, flow line 30 can run generally parallel to tool body assembly 20, and more than one flow line 30 can be attached to frac manifold 25 (see FIG. 10).

FIGS. 11-14 show various views of a preferred embodiment of primary clamp apparatus 10 without corresponding plates 2 and 4 that act as securing means around tool body 20 and flow line 30, respectively.

FIGS. 15-18 show various views of a preferred embodiment of secondary clamp apparatus 210 without corresponding plates 2 and 4 that act as securing means around tool body 20 and flowline 30, respectively.

FIG. 26 shows an example of a top drive 300 that can be screwed into top sub or pipe section 40 of frac head 20 in case fluid flow is needed through the rig pumps. An elevator clamp can be clamped or secured around the diameter of upset component 41 of tool body 20.

Figure 27:
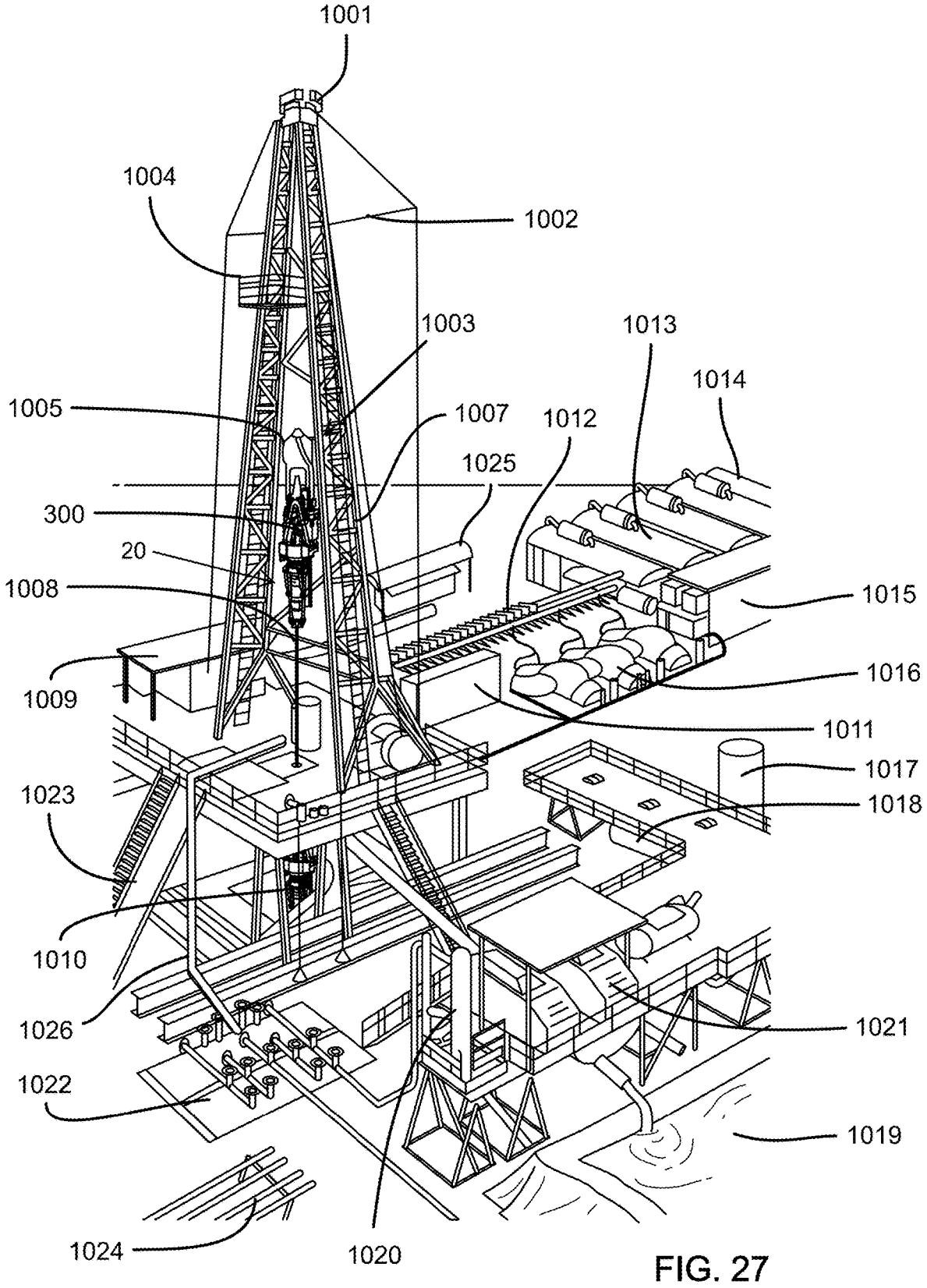
FIG. 27 is an overview of the components involved in a hydraulic fracturing process, including an offshore frac assembly and the apparatus of the present invention.

FIG. 27 shows an example of a drill rig set up and its various components. One skilled in the art of oil well drilling and the production industry is familiar with hydraulic fracturing systems and their various components and how they work. The hydraulic fracturing system in FIG. 27 includes crown block and water table 1001, catline boom and hoist line 1002, monkey board 1004, drilling line 1003, mast 1007, traveling block 1005, top drive 300, drill pipe 1008 or tool body 20 with flow line 1026 connected to frac pump manifold 1022 and blow out preventer 1010 that goes down hole. FIG. 27 shows doghouse 1009, pipe ramp 1023, and accumulator 1025 located close to the rig and with electric cable tray 1012 leading from the rig platform to engine generator sets 1013, fuel tanks 1014, and electric control house 1015. Water tank 1011 is seen adjacent to the rig platform with mud pump 1016 nearby. Also located adjacent to the rig platform are mud gas separator 1020, bulk mud components storage 1017 and mud pits 1018, shale shaker 1021 and reserve pits 1019. Additional pipe racks 1024 can be seen as well.

Figure 28:
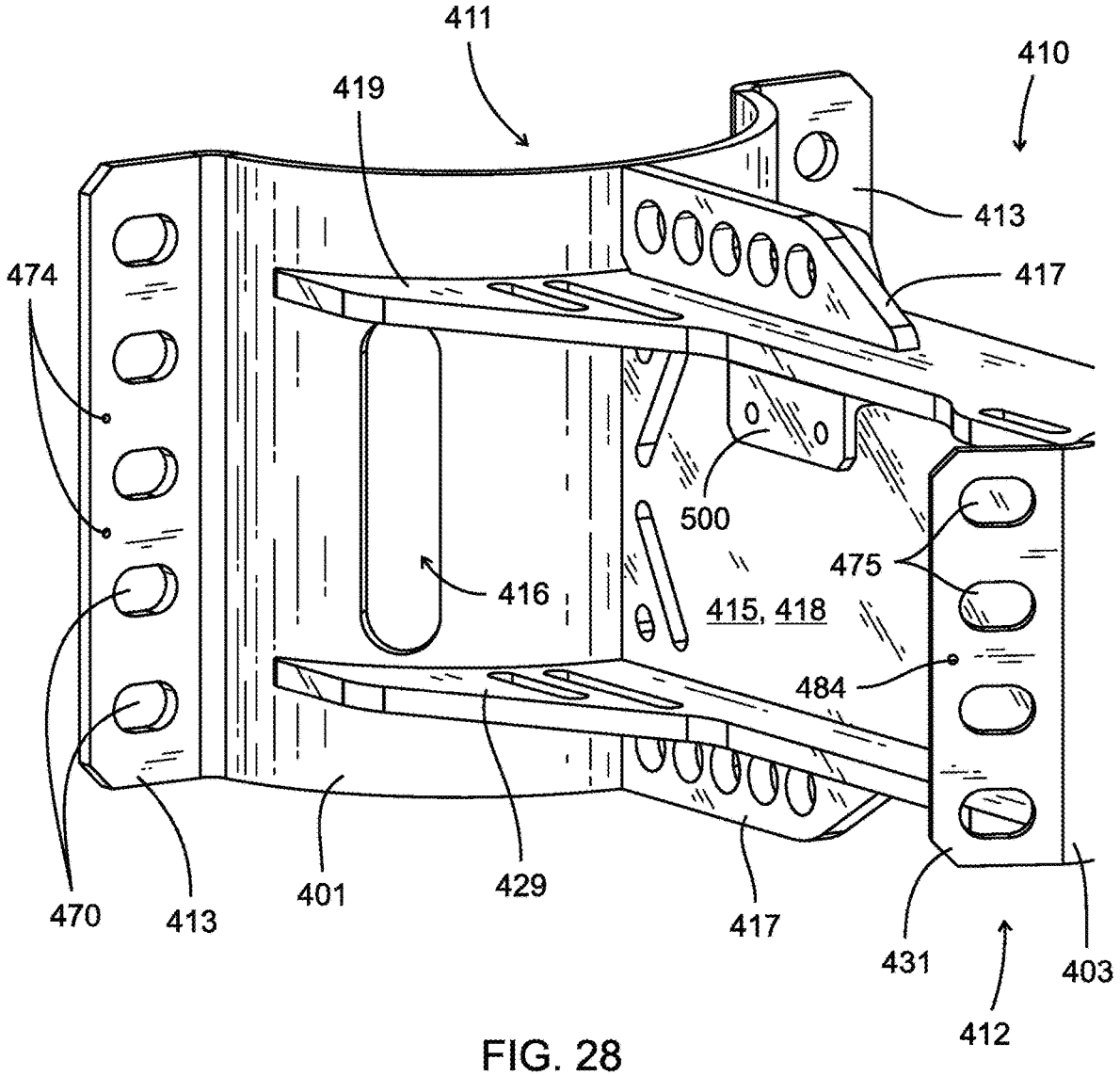
FIGS. 28 and 29 show various views of an alternative embodiment of the apparatus of the present invention.
Figure 29:
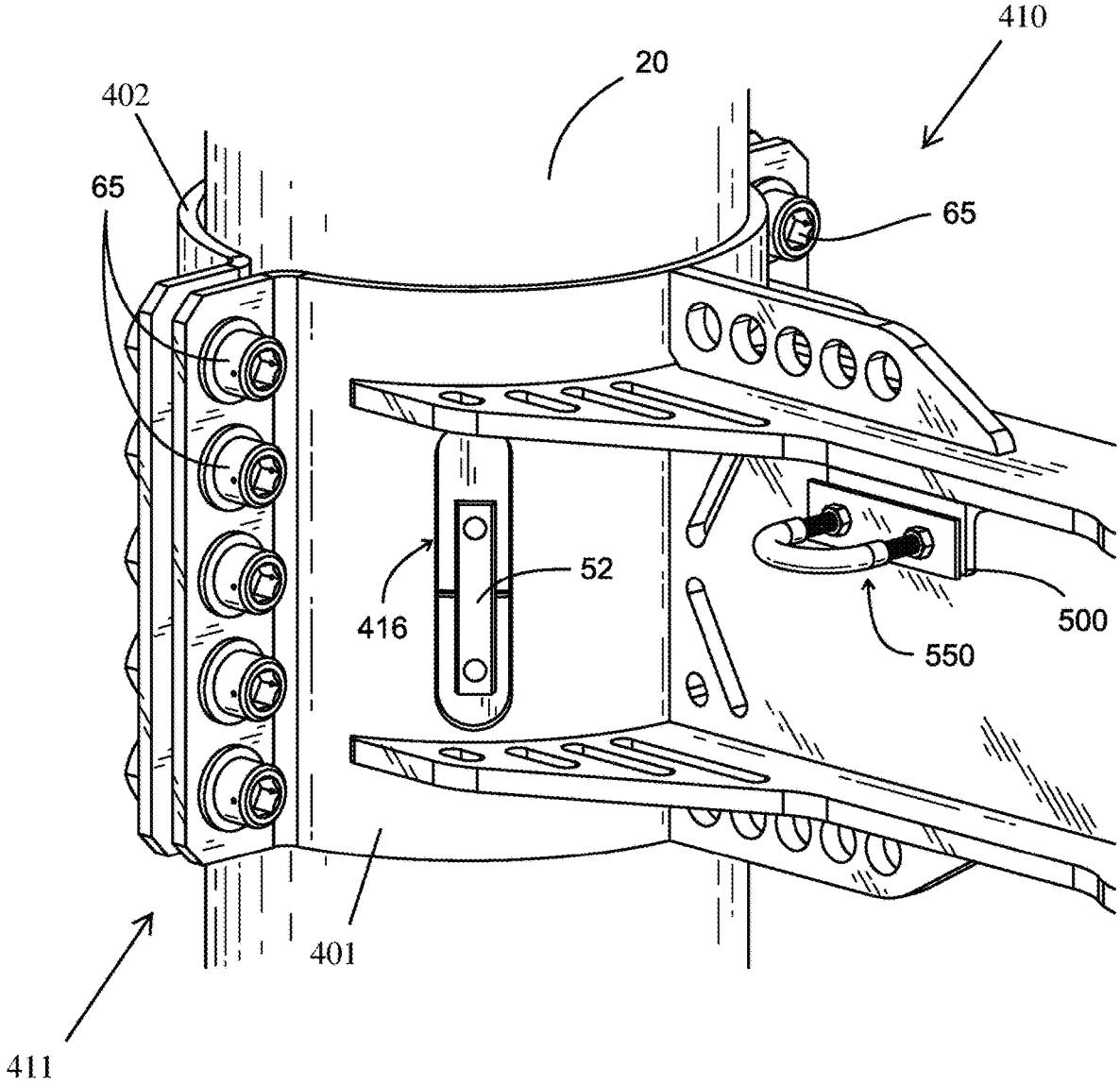
Figure 30:
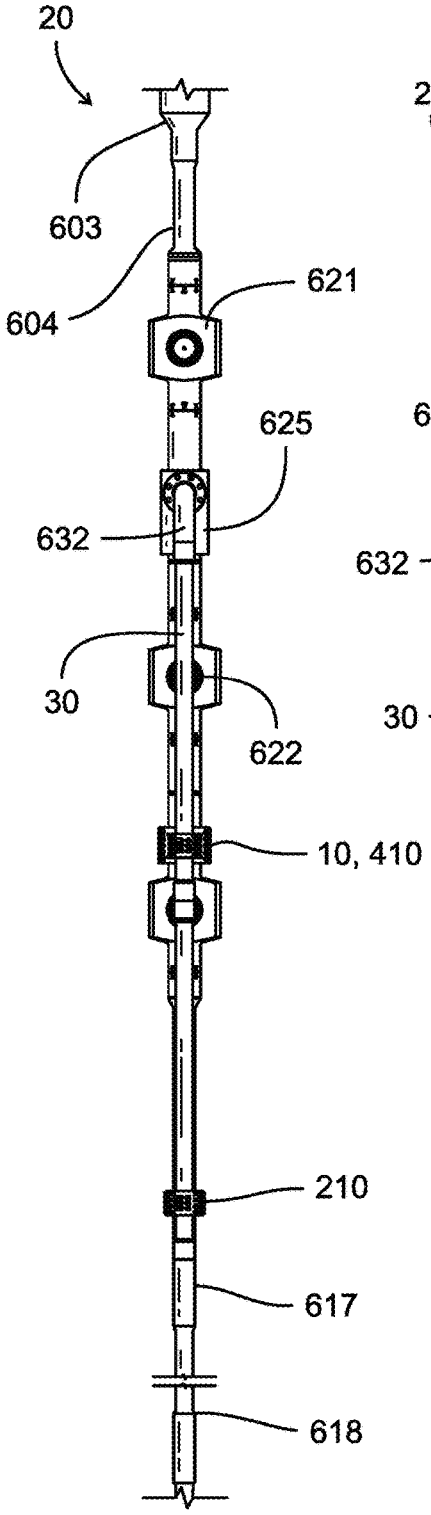
FIGS. 30-35 show various views of an offshore frac head assembly that can include preferred embodiments and/or alternative embodiments of the apparatus of the present invention.
Figure 31:
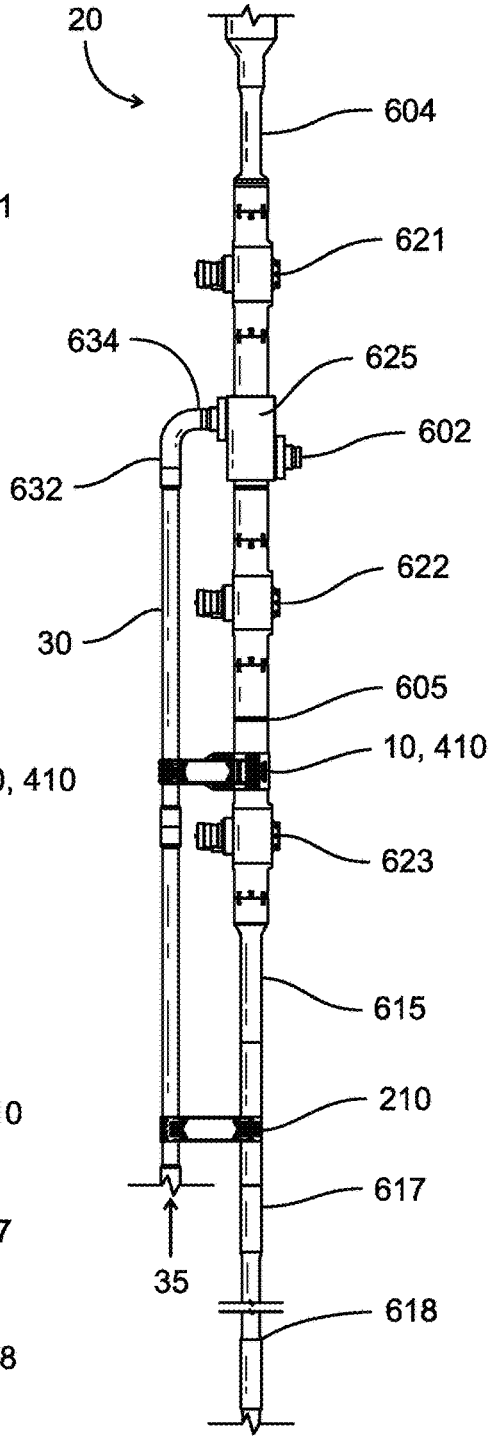
Figure 32:
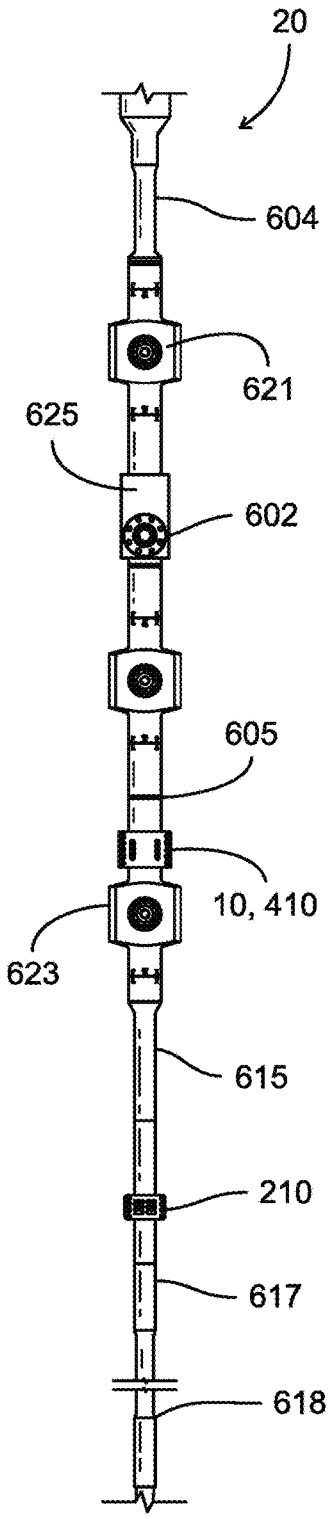
Figure 33:
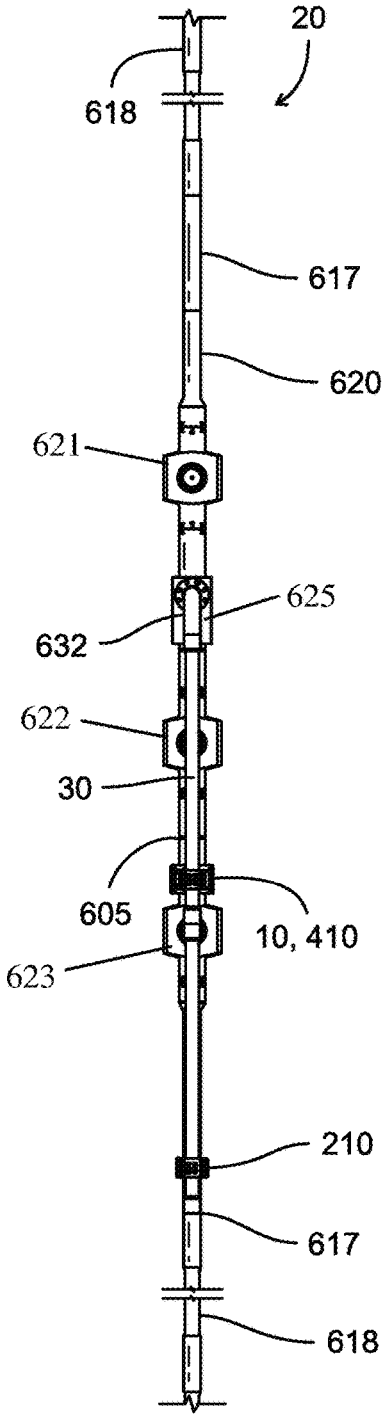
Figure 34:
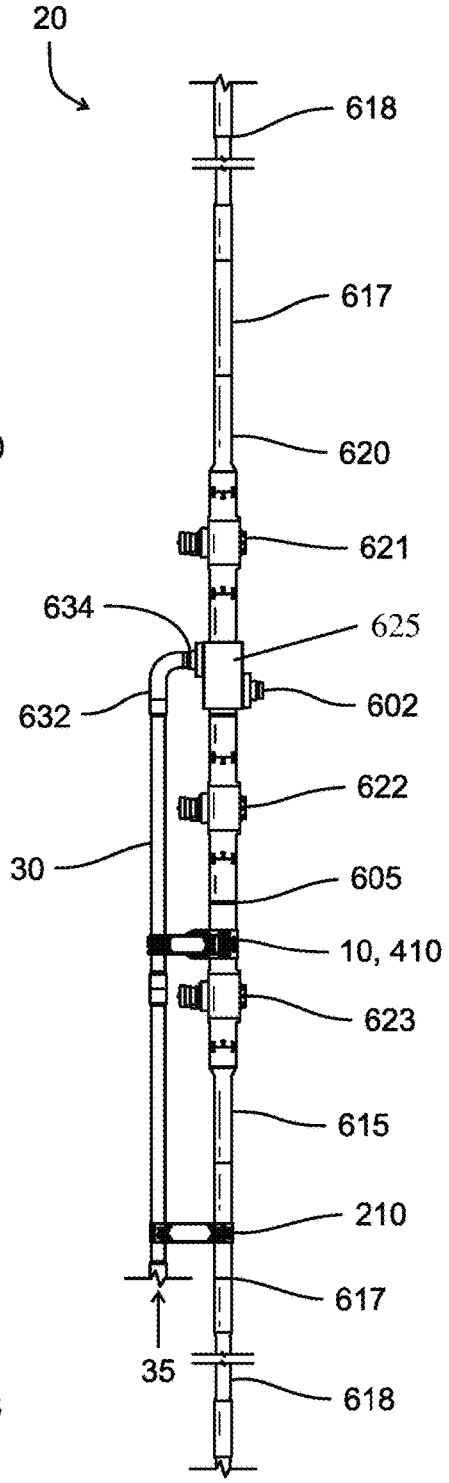
Figure 35:
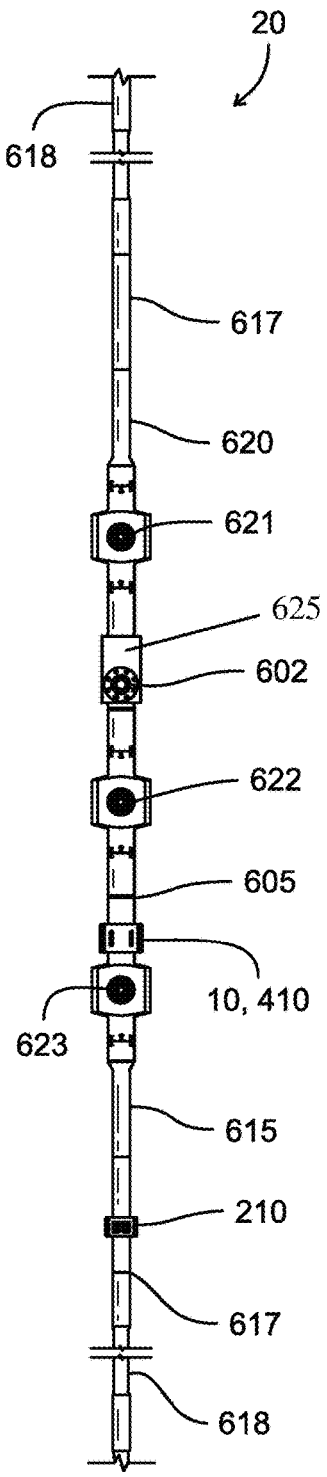
Figure 36:
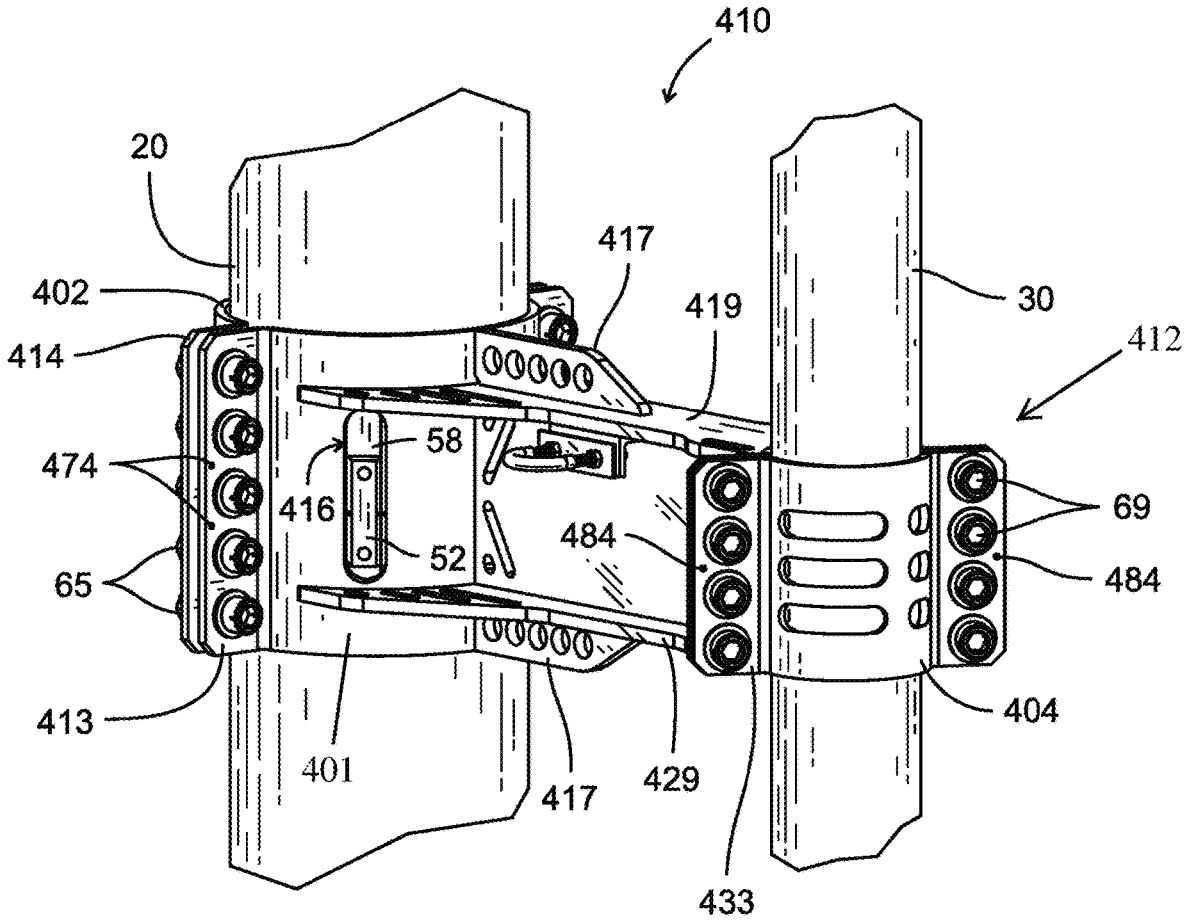
FIG. 36 shows a perspective view of an alternative embodiment of the apparatus of the present invention.

FIGS. 28, 29, and 36 show perspective views of an alternative embodiment of primary clamp apparatus, designated generally by the numeral 410. Clamp apparatus 410 can be similar to clamp apparatus 10. Clamp apparatus 410 preferably includes clamp body 415 with clamp segment 411 at one end of clamp body 415 and with clamp segment 412 at the opposing or distal end of clamp body 415. Clamp segment 411 can be secured around tool body 20, and clamp segment 412 can be secured around flow line 30. Clamp segment 411 preferably includes first plate or concave member 401 that is preferably, generally U-shaped, and a corresponding second plate or concave member 402 (see FIGS. 29 and 36) that is also preferably generally U-shaped. The shape and size of concave member 401 and member 402 preferably generally mimic each other (similarly to how plate 1 and plate 2 of clamp 10 generally mimic each other). Clamp segment 411 preferably also includes fastening plate, clip or slotted apertured plates 413 on each end of concave member 401 as seen in FIG. 28. Clamp segment 411 preferably also includes fastening plate, clip, or slotted apertured plates 414 on each end of concave member 402 as seen in FIG. 36. Each concave plate 413 preferably includes slots or openings 470 sized and shaped to accommodate bolted connections 65 (shown in FIGS. 29 and 36) that secure clamp apparatus 410 around tool body 20. Aperture plates 414 also have slots or openings that are sized and shaped to accommodate bolts 65. Slots or openings on aperture plates 414 generally correspond to the size, shape and placement of slots or openings 470 on plates 413. As shown in FIGS. 28 and 36, plates 413 can have apertures/holes/slots 474, and plates 414 can have corresponding apertures/holes/slots that correspond to holes 474. These holes 474 and the corresponding holes on plates 414 can be sized and shaped to accommodate cable seals/ties to attach separate components together (such as plates 413 to plates 414) in redundancy. Cable ties (such as those seen in https://seals.com/4-mm-barcoded-cable-seal-cablelock-4/, for example) provide both security and added safety. Clamp segment 412 preferably includes concave member 403 (as partially seen in FIG. 28) with slotted apertured plates 431 on each opposing end of member 403. Clamp segment 412 also preferably includes concave member 404 (see FIG. 36), that preferably corresponds in size and shape to member 403, and has slotted plates 433 on each end of member 404. Plates 431 and 433 can have apertures/holes/slots 475 that generally line up with each other and are sized and shaped to accommodate bolts 69 that are inserted into/threaded through slots/apertures 475 and secured in order to secure second clamp component 412 around flow line 30 (see FIG. 36). As shown in FIG. 28, plates 431 can have at least one aperture/slot/hole 484. Plates 433 can have corresponding or similar apertures/holes that correspond to hole(s) 484. Hole(s) 484 and the corresponding hole(s) on plates 433 can be sized and shaped to accommodate cable seals/ties to attach separate components together (such as plates 431 to plates 433) in redundancy. Examples of cable ties that can be used are seen at https://seals.com/4-mm-barcoded-cable-seal-cablelock-4/.

Clamp apparatus 410 can also include one or more lock key pockets 416 as shown in FIGS. 28 and 29. Lock key pockets 416 can be similar to lock key pockets 16 of clamp apparatus 10. Lock key pockets 416 can be used to secure the flow line circumferential forces, as well as a clamp force capable of securing gravitational forces and momentary forces. In order to secure the torsional forces of the assembly, frac head assembly 20 can have the mating lock keys and dove tail lock pockets within the primary member assembly. Lock key pockets 416 can double as alignment features for the high-pressure valves. The presence of lock keys 52 on frac head assembly 20 aides in securing torsional forces of assembly 20. If one or more clamp apparatuses 410 are used, key or sliding portion 52 can be sized and shaped to fit within lock key pocket 416 of the clamp apparatus (as shown in FIGS. 29 and 36, for example).

Clamp body 415 or web 418 of clamp apparatus 410 also preferably includes upper flange 419 and lower flange 429 that can run generally parallel to each other, but preferably also run generally perpendicular to web 418 as shown in FIGS. 28 and 29. Also seen in FIGS. 28, 29, and 36 are gussets 417 which can provide support, stabilization, and structural integrity. Gussets 417 can also operate as a lift point or handling point. Located on clamp body 415, as seen in FIGS. 28, 29, and 36 is plate or base 500. FIGS. 29 and 36 show u-bolt 550 that can be secured to plate 500. Several clamp apparatuses 410 can be used along frac head assembly 20, and u-bolts 550 on each clamp 410 can secure one or more hydraulic control lines that energize the valve actuators. Securing these lines prevents possible damage to the equipment as well as the potential of loose hoses hanging up in moving equipment.

FIGS. 30-35 show various views of another example of an offshore hydraulic fracturing or fracking tool body, designated generally by the numeral 20. This offshore hydraulic fracturing assembly 20 can also include a series of high-pressure valves (first valve 621, second valve 622, third valve 623) and a multi-inlet flow manifold 625. Valves 621, 622, and 623 can each have a work pressure rating of 15,000 psi, for example. As shown in FIGS. 30-35, flow line 30 can attach to or be connected to manifold 625 with flow line adapter 634 and elbow 632. A wing union 35 can also be attached to flow line 30. Manifold 625 can have secondary inlet 602. (Secondary inlet 602 can be a 4" 1502 STD WECO, for example.) Fracking tool body 20 can also include studded connection 603 and CT handling joint 604. (Studded connection 603 can be a 5⅛" 15M studded connection, for example. CT handling joint 604 can have a lift shoulder OD of 8.5" and a lift shank OD of 6.625", for example.) Tool body 20 can include adapter sub 605 located between valve 622 and primary clamp apparatus 10 (or 410). Tool body 20 can also include top sub 620 and bottom sub 615. Bottom sub can be located between valve 623 and secondary clamp apparatus 210. Tool body can also include crossover sub 617 and handling pup joint 618.

In general, clamp apparatuses 10, 210, and 410 can be used in any combination together to attach to and secure a tool body and its associated flow line(s).

PARTS LIST

The following is a list of parts and materials suitable for use in the present invention:

| Parts Number | Description |
|---|---|
| 1 | first plate/segment of first clamp component 11/concave member |
| 2 | corresponding plate/segment or second plate/segment of first clamp component 11/concave member |
| 3 | first plate/segment of second clamp component |
| 4 | corresponding plate/segment or second plate/segment of second clamp component 12/concave member |
| 5 | rig floor/platform |
| 10 | primary clamp apparatus/clamp apparatus |
| 11 | first clamp component of clamp apparatus 10 |
| 12 | second clamp component of clamp apparatus 10 |
| 13 | fastening mechanism/clip/plate of first plate 1/slotted or apertured plate |
| 14 | fastening mechanism/clip/plate of corresponding plate |
| 15 | clamp body of clamp apparatus 10 |
| 16 | lock key pocket of clamp apparatus 10 |
| 17 | gusset of clamp apparatus 10 |
| 18 | web |
| 19 | flange (upper) |
| 20 | offshore frac head assembly/offshore hydraulic fracturing assembly/fracking tool body |
| 21 | first valve |
| 22 | second valve |
| 23 | third valve |
| 25 | flow manifold/fracking manifold/multi-inlet flow |
| 26 | blind flange/cap |
| 27 | workstring/drill pipe |
| 28 | connection segment or portion of valve 23 |
| 29 | flange (lower) |
| 30 | flow line/flowline |
| 31 | apertured or slotted plate |
| 32 | elbow of flow line 30/elbow fitting |
| 33 | apertured or slotted plate |

-continued

| Parts Number | Description |
|---|---|
| 34 | adapter of flow line 30/adapter |
| 35 | wing union (4" 1502 STD WECO, for example) |
| 40 | top sub/pipe section |
| 41 | upset feature/component of top sub 40 |
| 42 | non-upset feature/component of top sub 40 |
| 45 | alignment sub/pipe section |
| 50 | lock/torque key apparatus |
| 52 | sliding portion/lock key/protrusion |
| 53 | screw |
| 54 | connection shoulder |
| 55 | threaded connection |
| 56 | main portion of indentation/pocket 58 |
| 57 | end of indentation/pocket 58 |
| 58 | indentation/lock key pocket |
| 59 | end of indentation/pocket 58 |
| 60 | lower sub/pipe section |
| 61 | upper portion/upset diameter of lower sub 60 |
| 62 | lower portion/non-upset area of lower sub 60 |
| 65 | bolted connections/fasteners/bolt and nut |
| 69 | bolted connections/fasteners/bolt and nut |
| 113 | fastening mechanism/clip/plate of plate 3 |
| 114 | fastening mechanism/clip/plate of plate 4 |
| 210 | secondary clamp apparatus/clamp apparatus |
| 211 | first clamp segment of clamp apparatus 210 |
| 212 | second clamp segment of clamp apparatus 210 |
| 215 | clamp body of clamp apparatus 210 |
| 300 | top drive |
| 310 | ventilator |
| 315 | disk brake |
| 320 | tank |
| 325 | main motor |
| 330 | guide beam |
| 335 | link |
| 340 | elevator |
| 345 | balance cylinder |
| 350 | bail |
| 355 | wash pipe assembly |
| 360 | gearbox |
| 365 | rotating head |
| 370 | tilt cylinder |
| 375 | back-up tong |
| 401 | first plate/segment of first clamp component 411/concave member |
| 402 | second plate of first clamp component 411/concave member |
| 403 | first plate/segment of second clamp component 412/concave member |
| 404 | second plate/segment of second clamp component 412/concave member |
| 410 | primary clamp apparatus |
| 411 | first clamp component/segment of clamp apparatus 410 |
| 412 | second clamp component/segment of clamp apparatus |
| 413 | fastening mechanism/clip/slotted or apertured plate |
| 414 | fastening mechanism/clip/slotted or apertured plate |
| 415 | clamp body of clamp apparatus 410 |
| 416 | lock key pocket of clamp apparatus 410 |
| 417 | gusset of primary clamp apparatus 410 |
| 418 | web |
| 419 | flange (upper) |
| 429 | flange (lower) |
| 431 | apertured or slotted plate |
| 433 | apertured or slotted plate |
| 470 | slot/opening |
| 474 | aperture/receptacle/hole |
| 475 | slot/opening |
| 484 | aperture/receptacle/hole |
| 500 | plate/U-bolt base/receptacle |
| 550 | U-bolt |
| 602 | secondary inlet |
| 603 | studded connection (ring num.: BX-169, for example) |
| 604 | handling joint |
| 605 | adapter sub (2X service conn., for example) |
| 615 | bottom sub (service conn. X 6⅝ FH pin, for example) |
| 617 | crossover sub (6⅝ FH Box x GP TF-M575 Pin, for |
| 618 | handling pup joint (5⅞" 34.21ppf Z-140, GP TF-M575 x 10', TJOD: 7.0", TJID: 4.250", for example; GP TF-M575 Box x 6⅝ FH Pin, for example) |

-continued

| Parts Number | Description |
|---|---|
| 620 | top sub (6⅝ FH Box x Service Conn., for example) |
| 621 | valve |
| 622 | valve |
| 623 | valve |
| 625 | manifold |
| 632 | elbow/elbow fitting |
| 634 | flow line adapter |
| 1001 | crown block and water table |
| 1002 | catline boom and hoist line |
| 1003 | drilling line |
| 1004 | monkey board |
| 1005 | traveling block |
| 1007 | mast |
| 1008 | drill pipe |
| 1009 | doghouse |
| 1010 | blow out preventer |
| 1011 | water tank |
| 1012 | electric cable tray |
| 1013 | engine generator sets |
| 1014 | fuel tanks |
| 1015 | electric control house |
| 1016 | mud pump |
| 1017 | bulk mud components storage |
| 1018 | mud pits |
| 1019 | reserve pits |
| 1020 | mud gas separator |
| 1021 | shale shaker |
| 1022 | frac pump manifold |
| 1023 | pipe ramp |
| 1024 | pipe racks |
| 1025 | accumulator |
| 1026 | flow line |
| X-X | axis |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A hydraulic fracturing apparatus, comprising:

a) a tool body;

b) a work string connected to and that is depending downwardly from the tool body;

c) a flowline that is spaced laterally away from the tool body and work string;

d) a clamp body having a first end and a second end, with said first end spaced away from said second end;

e) a first clamp segment located at said first end of said clamp body, wherein said first clamp segment has a fastening mechanism and a first concave member;

f) a second clamp segment located at said second end of said clamp body that has a second concave member;

g) wherein said first clamp segment is sized and shaped to engage said tool body;

h) wherein said second clamp segment is sized and shaped to engage said flowline;

i) the clamp body having a pair of spaced apart flanges connected by a web, each of said flange and said web connecting to each said first and second concave member;

j) each concave member having opposed slotted or apertured plates;

k) third and fourth concave members that are each connectable to a said first or second concave member in a connected position that connects said first clamp segment and said first concave member to the tool body and work string and that connects said second clamp segment and second concave member to said flowline;

l) Wherein each concave member is fitted with a pair of opposed slotted or apertured plates; and m) a plurality of bolted connections that secure each said third and fourth concave member to a said clamp segment.

2. The fracturing apparatus of claim 1, wherein said flowline is generally parallel to said tool body.

3. The fracturing apparatus of claim 1, further comprising one or more gussets located on said clamp body, each gusset connecting a said flange to a said concave member.

4. The fracturing apparatus of claim 3, wherein said one or more gussets are located on said first end of said clamp body.

5. The fracturing apparatus of claim 4, wherein said one or more said gussets are positioned to stabilize said clamp when said apparatus is fastened around or clamped to said tool body and said flowline.

6. The fracturing apparatus of claim 3, wherein said one or more gussets are positioned to stabilize said clamp when said apparatus is fastened to said tool body and said flowline.

7. The fracturing apparatus of claim 3, wherein said one or more of said gussets have a lift eye.

8. The fracturing apparatus of claim 1, wherein said slotted or apertured plates of said first concave member are generally co-planar.

9. The fracturing apparatus of claim 1, wherein said first clamp segment has one or more lock key pockets.

10. The fracturing apparatus of claim 9, wherein said one or more lock key pockets and lock keys secure said tool body to said clamp body.

11. The fracturing apparatus of claim 1, further comprising bolted connections that secure one concave member to another said concave member.

12. The fracturing apparatus of claim 11, wherein the slotted or apertured plates of said first clamp segment form an acute angle with the slotted or apertured plates of said second clamp segment.

13. The fracturing apparatus of claim 11, further comprising one or more gussets located on said clamp body, each gusset connecting a said flange to a said concave member, wherein said one or more gussets help to stabilize said fracturing apparatus at said slotted or apertured plates when said apparatus is fastened to said tool body and said flowline.

14. A hydraulic fracturing apparatus, comprising:

a) an elongated well string that includes a tool body;

b) a flow line spaced laterally away from said well string;

c) a clamping apparatus that connects to both said well string and said flow line, said clamping apparatus including a clamp body having first and second clamp body end portions;

d) said first clamp body end portion configured to engage and connect with said well string;

e) said second clamp body end portion configured to engage and connect with said flow line;

f) a first clamp segment located at said first end of said clamp body, wherein said first clamp segment has a fastening mechanism and a concave member;

g) a second clamp segment located at said second end of said clamp body, wherein said second clamp segment has a concave member;

h) wherein said first clamp segment is sized and shaped to engage said tool body;

i) wherein said second clamp segment is sized and shaped to engage said flow line;

j) the clamp body having a pair of spaced apart flanges connected by a web, each of said flange and said web connecting to each said concave member;

k) each concave member having opposed connection plates; and l) third and fourth concave members, each having connection plates and that are each connectable to a said first or second concave member at said connection plates with a bolted connection.

15. The fracturing apparatus of claim 14, wherein said flow line is generally parallel to said tool body.

16. The fracturing apparatus of claim 14, further comprising one or more gussets located on said clamp body, each gusset connecting a flange to a concave member.

17. The fracturing apparatus of claim 16, wherein said one or more gussets are located on said first end of said clamp body.

18. The fracturing apparatus of claim 16, wherein said one or more of said gussets have a lift eye.

19. The fracturing apparatus of claim 14, wherein said plates are generally co-planar.

20. The fracturing apparatus of claim 14, wherein said first clamp segment has one or more lock key pockets and locks that interface with said pockets.

21. A hydraulic fracturing apparatus, comprising:

a) an elongated well string that includes a tool body;

b) a flowline spaced laterally away from said well string;

c) a clamping apparatus that connects to both said well string and said flowline, said clamping apparatus including a clamp body having first and second clamp body end portions;

d) each clamp body end portion configured to engage and connect with said well string or said flowline, wherein said well string and said flowline are of differing diameters;

e) a first clamp segment located at said first end of said clamp body, wherein said first clamp segment has a fastening mechanism and a first concave member;

f) a second clamp segment located at said second end of said clamp body that has a fastening mechanism and a second concave member;

g) wherein said first clamp segment is sized and shaped to engage said well string;

h) wherein said second clamp segment is sized and shaped to engage said flowline;

i) the clamp body having a pair of spaced apart flanges connected by a web, each of said flanges and said web connecting to each said first and second concave members;

j) each concave member having opposed slotted or apertured plates;

k) third and fourth concave members that are each connectable to a said first or second concave member; and l) Bolted connections that secure the third and fourth concave members to the clamp body.

* * * * *